US010750829B2

(12) United States Patent
Dieter

(10) Patent No.: US 10,750,829 B2
(45) Date of Patent: Aug. 25, 2020

(54) METHOD OF MAKING A CUSTOMIZATION KIT FOR ARTICLES OF FOOTWEAR

(71) Applicant: NIKE, Inc., Beaverton, OR (US)

(72) Inventor: William M. Dieter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 280 days.

(21) Appl. No.: 15/595,247

(22) Filed: May 15, 2017

(65) Prior Publication Data

US 2018/0325220 A1 Nov. 15, 2018

(51) Int. Cl.

| | |
|---|---|
| ***B32B 38/00*** | (2006.01) |
| ***B65D 85/18*** | (2006.01) |
| ***B29C 65/00*** | (2006.01) |
| ***A43D 95/12*** | (2006.01) |
| ***B65D 5/42*** | (2006.01) |
| *A43D 3/14* | (2006.01) |
| *A43B 7/28* | (2006.01) |

(52) U.S. Cl.

CPC ..... *A43D 95/12* (2013.01); *B65D 5/4295* (2013.01); *B65D 85/187* (2013.01); *A43B 7/28* (2013.01); *A43D 3/1408* (2013.01)

(58) Field of Classification Search

CPC ..... A43D 95/12; A43D 3/1408; A43D 11/14; B65D 85/187; B65D 5/4295; B65D 1/40; B65D 7/12; D06F 58/10; D06F 58/14; Y10T 156/1015; B29C 53/36; B29C 66/43; B32B 38/0004; B32B 37/04; B32B 37/0076; B32B 37/0084; B32B 37/065; B32B 37/30; B31B 70/00; B31B 70/16; B31B 2160/106

USPC ..... 71/34; 156/196, 250; 220/62.22, 32.11, 220/378, 677; 493/194, 210; 223/51, 57, 223/70, 76, 78

See application file for complete search history.

(56) References Cited

U.S. PATENT DOCUMENTS

| | | | | |
|---|---|---|---|---|
| 3,380,646 | A | 4/1968 | Doyen | |
| 4,057,144 | A | 11/1977 | Schuster | |
| 4,630,310 | A * | 12/1986 | Winesett | B65D 33/002 206/820 |
| 4,795,665 | A * | 1/1989 | Lancaster | B29C 65/1425 426/106 |
| 4,892,604 | A | 1/1990 | Measells et al. | |
| 5,080,643 | A | 1/1992 | Mitchell et al. | |
| 5,735,423 | A | 4/1998 | Black | |
| 5,947,287 | A | 9/1999 | Weiss et al. | |
| 6,231,237 | B1 | 5/2001 | Geller | |
| 8,579,779 | B2 * | 11/2013 | Totani | B65D 31/08 493/189 |
| 8,627,528 | B2 * | 1/2014 | Baker | A43D 3/1408 12/128 R |
| 9,017,505 | B2 * | 4/2015 | Gallagher | A41D 27/245 156/256 |

(Continued)

*Primary Examiner* — Lawrence Averick

(74) *Attorney, Agent, or Firm* — Banner & Witcoff, Ltd.

(57) ABSTRACT

A method of making a steaming apparatus for an article of footwear includes providing a set of sheets and applying a series of welds and cuts to the sheets. The resulting steaming apparatus can have a steaming chamber adjoined to a plurality of wing portions. The apparatus also includes provisions for securing the article of footwear within the steaming chamber such that a majority of the upper is subjected to steam. Articles of footwear may be placed in the steaming system to help customize the articles of apparel for a user's fit and comfort.

20 Claims, 12 Drawing Sheets

(56) References Cited

U.S. PATENT DOCUMENTS

| | | | | |
|---|---|---|---|---|
| 2012/0282425 | A1* | 11/2012 | Gallagher | A41D 27/245 428/61 |
| 2013/0305664 | A1* | 11/2013 | Arroyo Yillan | B29C 65/02 53/469 |
| 2014/0169704 | A1 | 6/2014 | Dieter et al. | |
| 2015/0175343 | A1 | 6/2015 | Baker et al. | |
| 2015/0344189 | A1 | 12/2015 | Sasaki et al. | |

* cited by examiner

METHOD OF MAKING A CUSTOMIZATION KIT FOR ARTICLES OF FOOTWEAR

FIELD

The present embodiments relate to a steaming apparatus and a method of manufacturing the steaming apparatus, and in particular to a method of making a post-manufacturing customization system and a method of custom fitting an article of footwear through the use of the steaming apparatus.

BACKGROUND

Steam can be used to soften articles of apparel. Articles of footwear often include an upper and a sole structure. The upper comprises many different components, including various layers, sections, or segments of material. These components may be made from stock textile materials such as fabrics and leather goods that may be customized for a user.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
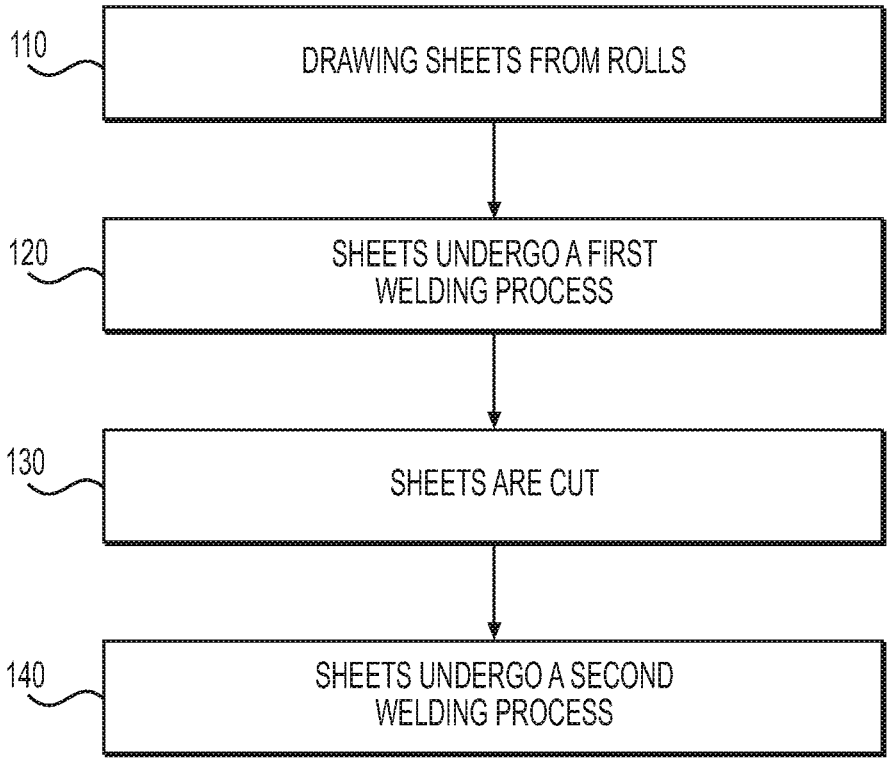
FIG. 1 is a flowchart depicting an embodiment of a method of making a steaming apparatus.

In one aspect, the present disclosure is directed to a method of manufacturing a steaming apparatus. The steaming apparatus includes a first panel, a second panel, a third panel, and a fourth panel. The method comprises folding a first sheet to form a first folded sheet, placing the first folded sheet between a second sheet and a third sheet to form a layered sheet set, and welding together a first portion of the layered sheet set to form a first weld portion in the layered sheet set, the first weld portion being directly adjacent to a first longitudinal edge of the layered sheet set and being elongated in a direction substantially aligned with a longitudinal axis of the layered sheet set. The method also includes cutting through the layered sheet set to separate the first panel from the first sheet, the second panel from the second sheet, the third panel from the third sheet, and the fourth panel from a fourth sheet, thereby separating a layered panel set from the layered sheet set, and welding together a bottom portion of the layered panel set to form a base portion in the steaming apparatus.

In another aspect, the present disclosure is directed to a method of manufacturing a steaming apparatus for use with an article of footwear. The method comprises drawing a substantially rectangular-shaped first sheet from a first roll, the substantially rectangular-shaped first sheet including a first edge, drawing a substantially rectangular-shaped second sheet from a second roll, the substantially rectangular-shaped second sheet including a second edge, and positioning the second edge adjacent to, and parallel with, the first edge. The method also includes drawing a substantially rectangular-shaped third sheet from a third roll, folding the substantially rectangular-shaped third sheet along a first longitudinal midline to form a first folded sheet such that a third edge of the substantially rectangular-shaped third sheet adjoins a fourth edge of the substantially rectangular-shaped third sheet, and placing the first folded sheet between the substantially rectangular-shaped first sheet and the substantially rectangular-shaped second sheet to form a layered sheet set. The method further comprises arranging the layered sheet set such that the first edge abuts the third edge and the second edge abuts the fourth edge, welding a first portion of the layered sheet set to form a first weld portion that includes a first elongated portion that is formed adjacent to both the first edge and the third edge, cutting a first panel from the substantially rectangular-shaped first sheet, a second panel from the substantially rectangular-shaped second sheet, and a third panel from the substantially rectangular-shaped third sheet, thereby facilitating removal of a layered panel set from the layered sheet set, and welding a bottom portion of the layered panel set to form a base portion.

In another aspect, the present disclosure is directed to a method of making a steaming apparatus for use with an article of footwear. The method comprises positioning a first inner surface of a first sheet over a second inner surface of a second sheet such that the first inner surface and the second inner surface face toward each other, the first sheet being substantially similar in width as the second sheet, folding a third sheet to form a first folded sheet with a first folded outer surface and a second folded outer surface, and placing the first folded sheet between the second sheet and the third sheet such that a first fold line of the first folded sheet is substantially parallel to a longitudinal axis of the second sheet. The method also includes placing a second folded sheet between the second sheet and the third sheet such that a second fold line of the second folded sheet is substantially parallel to the longitudinal axis of the second sheet, positioning the first folded sheet such that the first inner surface of the first sheet and the first folded outer surface of the first folded sheet contact each other, and the second inner surface of the second sheet and the second folded outer surface of the first folded sheet also contact each other, thereby forming a layered sheet set, and welding a first portion of the layered sheet set adjacent to a first edge of the layered sheet set in a direction substantially aligned with a longitudinal axis of the layered sheet set to form a first weld portion. In addition, the method comprises removing a first layered panel set from the layered sheet set by cutting through the layered sheet set, and welding a bottom portion of the first layered panel set, thereby forming a base portion of the steaming apparatus.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

Generally, a post-manufacturing customization system and method of custom fitting an article of footwear may be configured by providing a customer with an apparatus for steaming an article of footwear. In different embodiments, a customization kit or steaming apparatus—such as a steaming bag—may be used by a customer at home. For example, in some cases, a customer could purchase the steaming bag at a retail location and bring the steaming bag to his or her home. In other cases, the steaming bag may be shipped to an address associated with the customer. In other embodiments, the steaming bag could be used at any other location, such as a retail store or a kiosk.

Furthermore, the term "bag" as used throughout this detailed description and in the claims refers to an enclosure, container, or other structure that can be configured to receive, store, or hold one or more articles. Moreover, as used herein, a "bag" may be moved from one location to another. Specifically, a bag may be any container that is not required to be permanently secured or fixedly attached to a surface in order to operate, and is capable of being readily displaced by a single individual.

The following figures depict one embodiment of a method of manufacturing a steaming apparatus using a manufacturing assembly. It should be understood that the following figures are for purposes of illustration only, and each of the components or materials described herein may be included or referred to in the description while not illustrated in the figures.

A footwear customization kit can include provisions to facilitate steaming an article of footwear for modifying one or more customizable portions. In one embodiment, a customization kit can include a steaming apparatus for holding an article of footwear above or within a steaming source. In other embodiments, the steaming apparatus may be provided separately or individually to a customer or user. In different embodiments, the manufacture of a steaming apparatus can involve different steps. For purposes of clarity, FIG. 1 presents a flow chart depicting one embodiment of a method of manufacturing a steaming apparatus.

As shown in FIG. 1, in some embodiments, a first step 110 can comprise drawing a plurality of sheets from a set of rolls. In some embodiments, first step 110 can also include positioning each of the plurality of sheets in a particular arrangement with respect to each other, as will be described below with respect to FIGS. 2 and 3. In some embodiments, first step 110 can also include folding a first sheet to form a first folded sheet, and folding a second sheet to form a second folded sheet, and placing the first folded sheet between a second sheet and a third sheet to form a layered sheet set, for example.

In a second step 120, the sheets may undergo a first welding process in the manufacturing assembly. The first welding process can join together various portions of the layered sheets, as will be discussed below with respect to FIGS. 4 and 5. In some embodiments, second step 120 can also include welding together a first portion of the layered sheet set to form a first weld portion in the layered sheet set, such that the first welded portion is directly adjacent to a first longitudinal edge of the layered sheet set and elongated in a direction substantially aligned with a longitudinal axis of the layered sheet set, as detailed below.

In a third step 130, the sheets may be cut in various regions, allowing different portions of the sheets to be separated from the rest of the layered sheets. This will be illustrated in greater detail in FIGS. 6 and 7. In some embodiments, third step 130 can also include cutting through the layered sheet set to facilitate separation of a first panel from the first sheet, a second panel from the second sheet, a third panel from the third sheet, and a fourth panel from a fourth sheet, and separating a layered panel set from the layered sheet set.

In a fourth step 140, a second welding process can join additional portions of the layered sheets, as will be discussed with respect to FIGS. 8 and 9. In some embodiments, fourth step 140 can include welding together a bottom portion of the layered panel set to form a base portion in the steaming apparatus. In different embodiments, the method can generally produce a steaming apparatus comprising the first panel, the second panel, the third panel, and the fourth panel.

In order to provide the reader with a greater understanding of the embodiments disclosed herein, FIGS. 2-9 illustrate a series of steps that may be utilized during the manufacture of a steaming apparatus, as outlined above in FIG. 1. For purposes of clarity, the method depicts a sequence producing a single steaming apparatus; however, it will be understood that similar steps may be repeated to manufacture a second steaming apparatus, or a plurality of steaming apparatuses. Furthermore, in different embodiments, the manufacturing assembly and process shown may differ while the steps described above remain substantially similar.

Figure 2:
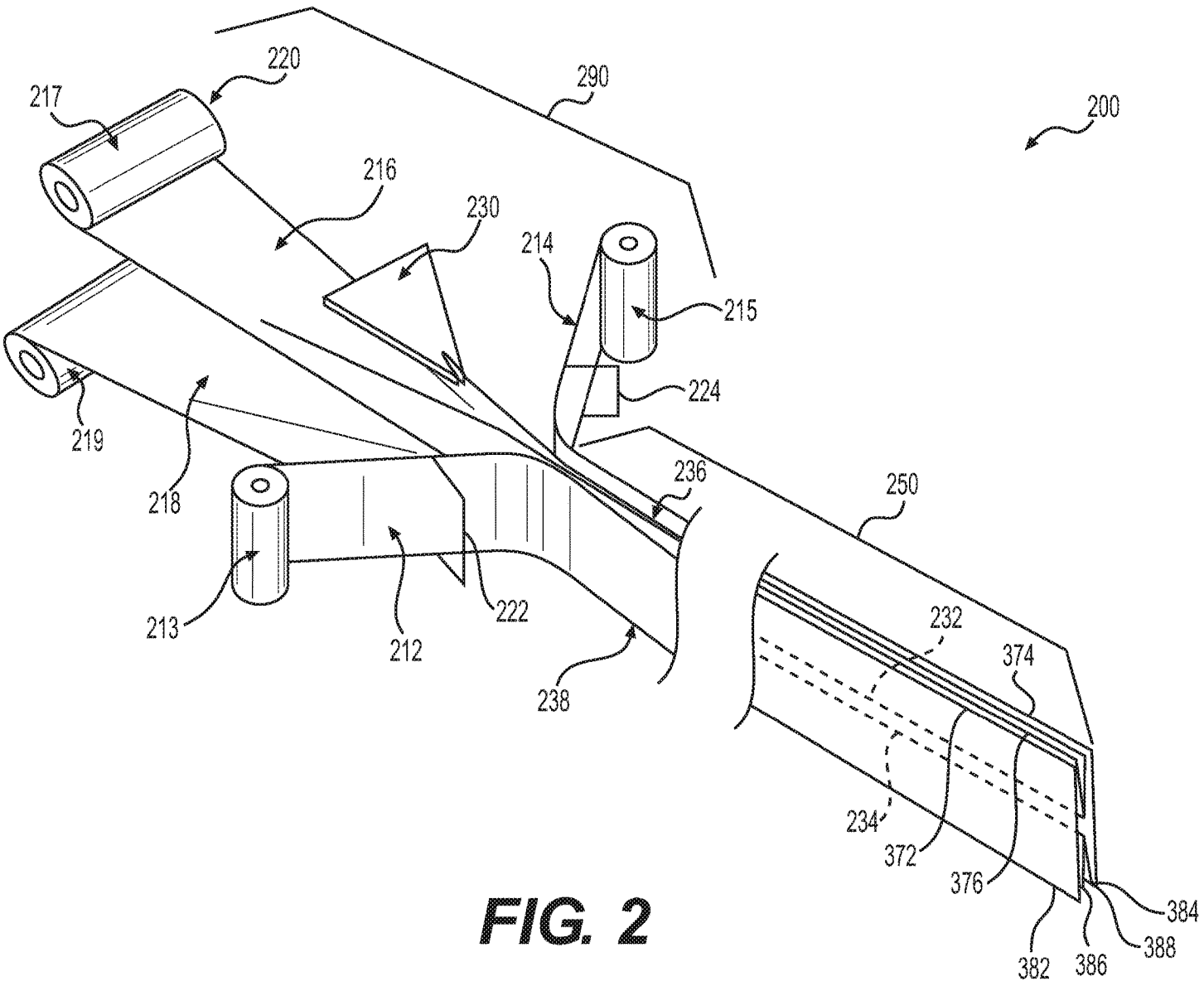
FIG. 2 is an embodiment of a manufacturing assembly with a rolling system.

Referring to FIG. 2, one embodiment of a portion of a manufacturing assembly 200 is shown, comprising a roller system 290. Roller system 290 includes a plurality of rolls and sheets, and a means for unrolling and drawing sheets from their respective rolls, as will be discussed further below. It should be understood that other embodiments of manufacturing assembly 200 may include fewer, different, or additional components, and include any component known in the art for manufacturing, cutting, rolling, welding, and/or handling of sheets or films. Thus, portions of the manufacturing assembly such as the entire frame, bearings, supports, and the like that are generally provided with respect to the functional members of a winding and forwarding sheet apparatus are not shown in the figures or described in detail in order to simplify and more clearly depict and disclose the present embodiments. It should be understood that such details would be obvious to persons of ordinary skill in the art of designing film or sheet-rolling machinery.

In FIG. 2, manufacturing assembly 200 includes a plurality of sheets ("sheets") 210, comprising a first sheet 212, a second sheet 214, a third sheet 216, and a fourth sheet 218. In some embodiments, sheets 210 can be routed or moved through manufacturing assembly 200. In one embodiment, sheets 210 can be unwound from a plurality of rolls ("rolls") 220. In other embodiments, any other means known in the art of providing a constant-tension sheet supply can be utilized. In FIG. 2, first sheet 212 is unwound or drawn from a first roll 213, second sheet 214 is unwound or drawn from a second roll 215, third sheet 216 is unwound or drawn from a third roll 217, and fourth sheet 218 is unwound or drawn from a fourth roll 219.

In some embodiments, first sheet 212 and second sheet 214 can have substantially similar dimensions. Thus, in one embodiment, a first width 222 of first sheet 212 is substantially similar to a second width 224 of second sheet 214. Furthermore, first sheet 212 is substantially rectangular in shape as it extends from first roll 213 and second sheet 214 is substantially rectangular as it extends from second roll 215. In other embodiments, first sheet 212 and second sheet 214 can differ in size and have any shape, including oblong, elliptical, or any other regular or irregular shape.

Furthermore, in some embodiments, third sheet 216 and fourth sheet 218 can also be substantially similar in shape and/or dimensions as first sheet 212 or second sheet 214. However, as each of third sheet 216 and fourth sheet 218 moves through manufacturing assembly 200, there may be provisions for folding or altering the shape or dimensions of third sheet 216 and fourth sheet 218 in different embodiments. For example, as shown in FIG. 2, first folding device 230 may be used to fold third sheet 216 into two, such that a forward portion of third sheet 216 comprises first folded sheet 236. Similarly, a second folding device (not shown) may be used to fold fourth sheet 218 into two, such that a forward portion of fourth sheet 218 comprises a second folded sheet 238. In some embodiments, third sheet 216 may be folded along a first longitudinal midline 232, such that first folded sheet 236 is divided into two substantially equal portions, and/or fourth sheet 218 may be folded along a second longitudinal midline 234, such that second folded sheet 238 is divided into two substantially equal portions. However, in other embodiments, the folding line may be associated with a different region of the sheet, and the two folded portions may not be equal in size.

In FIG. 2, it can be seen that as the unrolling of sheets 210 occurs, each roll is arranged in manufacturing assembly 200 to facilitate a particular positioning or configuration of each sheet with respect to the other sheets. For example, first sheet 212 and second sheet 214 are positioned as outermost or exterior sheet layers, and first folded sheet 236 and second folded sheet 238 are arranged between first sheet 212 and second sheet 214, and comprise interior sheet layers. For purposes of reference in the description and claims, it will be understood that the arrangement of first sheet 212 and second sheet 214 as they "sandwich" or surround first folded sheet 236 and second folded sheet 238 will be referred to as a layered sheet set 250.

Figure 3:
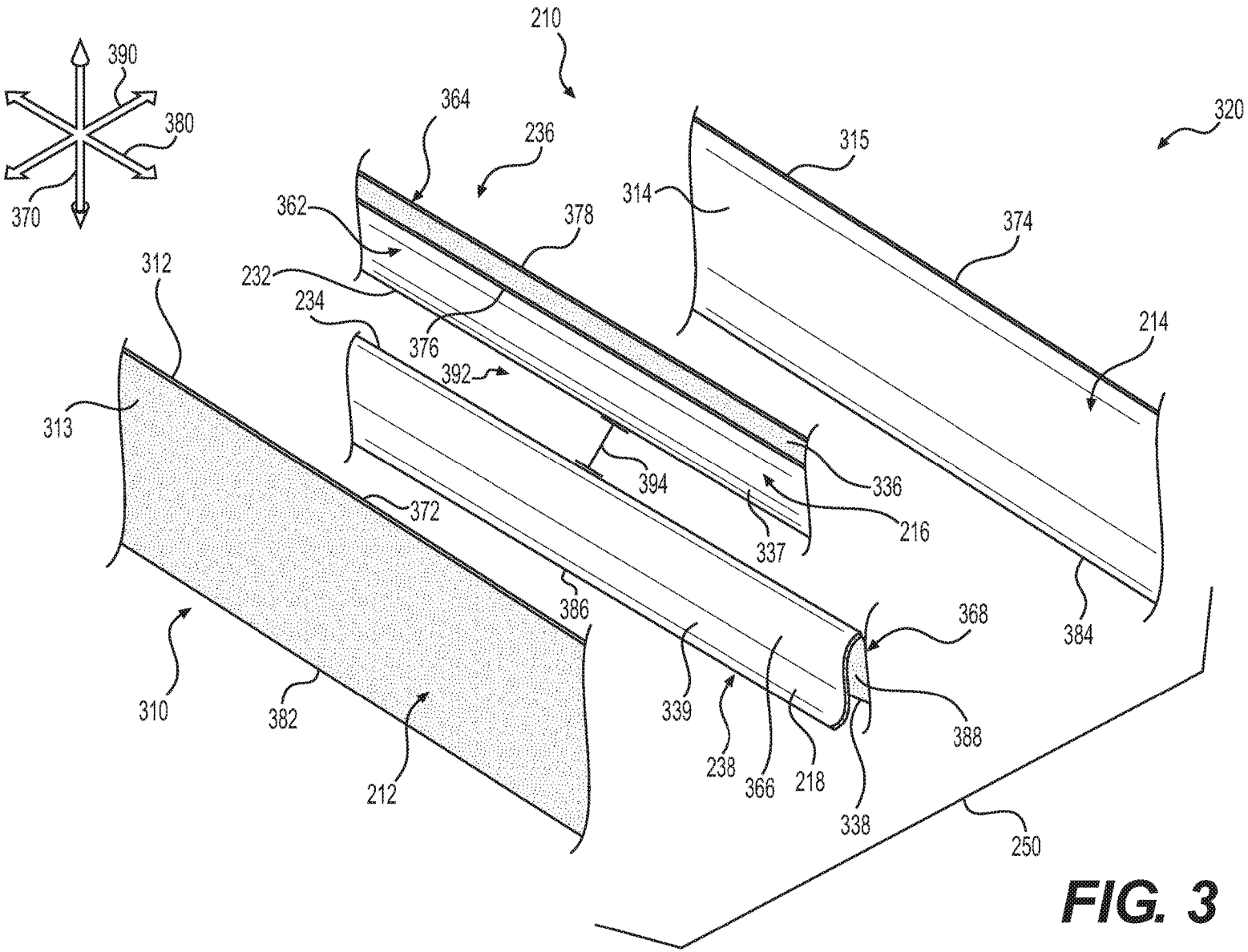
FIG. 3 is an embodiment of an exploded view of a portion of a set of sheets.

Referring now to FIG. 3, an exploded view of a portion of layered sheet set 250 is illustrated. Each of first sheet 212, second sheet 214, third sheet 216, and fourth sheet 218 can be substantially two dimensional in different embodiments. For purposes of this disclosure, the term "flat" or "two-dimensional material" or variants thereof is intended to encompass generally flat materials exhibiting a length and a width that are substantially greater than a thickness. In other words, a flat material may include some contours or curvature. Although flat or two-dimensional materials may have smooth or generally untextured surfaces, some two-dimensional materials will exhibit textures or other surface characteristics, such as dimpling, protrusions, ribs, or various patterns, for example. Despite the presence of surface characteristics or curvature, two-dimensional materials remain generally flat and exhibit a length and a width that are substantially greater than a thickness.

In some embodiments, sheets 210 can include two sides, or an inner surface and an outer surface. For example, in FIG. 3, first sheet 212 includes a first inner surface 312 and an opposite facing first outer surface 313, and second sheet 214 includes a second inner surface 314 and an opposite facing second outer surface 315. Similarly, first folded sheet 236 includes a third inner surface 336 and an opposite facing third outer surface 337, and second folded sheet 238 includes a fourth inner surface 338 and an opposite facing fourth outer surface 339.

In some embodiments, different sides of each sheet may face toward a portion of another sheet in layered sheet set 250. In FIG. 3, it can be seen that first outer surface 313 faces outward toward a first side 310, or in a proximal direction, relative to the remainder of layered sheet set 250. Similarly, second outer surface 315 faces outward toward a second side 320, or in a proximal direction, relative to the remainder of layered sheet set 250, where first side 310 and second side 320 represent opposite sides along a lateral axis 390. Furthermore, first inner surface 312 faces inward, or in a distal direction, toward the interior sheets comprising first folded sheet 236 and second folded sheet 238. Similarly, second inner surface 314 faces inward, or in a distal direction, toward first folded sheet 236 and second folded sheet 238. Thus, in some embodiments, it can be understood that first inner surface 312 and second inner surface 314 generally face toward each other.

In addition, in some embodiments, the interior sheet layers (i.e., first folded sheet 236 and second folded sheet 238) can be arranged between first inner surface 312 and second inner surface 314. In FIG. 3, first folded sheet 236 is disposed "above" second folded sheet 238 relative to a vertical axis 370. Furthermore, first longitudinal midline 232 of first folded sheet 236—associated with the fold line or bended region of first folded sheet 236—is substantially aligned with second longitudinal midline 234 of second folded sheet 238, which is associated with the fold line or bended region of second folded sheet 238. In one embodiment, first longitudinal midline 232 and second longitudinal midline 234 are parallel and extend through the same vertical plane, where the vertical plane has a length extending in a direction substantially aligned with a longitudinal axis 380.

Furthermore, in some embodiments, first longitudinal midline 232 and second longitudinal midline 234 may be spaced apart from one another. Thus, in some embodiments, there may be portions of first sheet 212 and second sheet 214 that face directly toward each other. In other words, central portion 392 of layered sheet set 250 may include only two layers in some embodiments. In different embodiments, there may be a central width 394 associated with the spacing between first longitudinal midline 232 and second longitudinal midline 234. The arrangement of first folded sheet 236 and second folded sheet 238 between first sheet 212 and second sheet 214 and the size of central width 282 can be configured to facilitate the welding and cutting of specific regions in some embodiments, as will be discussed further below.

For purposes of reference, first folded sheet 236 may be understood to include a first fold portion ("first fold") 362 and a second fold portion ("second fold") 364, and second folded sheet 238 may be understood to include a third fold portion ("third fold") 366 and a fourth fold portion ("fourth fold") 368. In some embodiments, the portion of third outer surface 337 associated with first fold 362 may face toward first inner surface 312 of first sheet 212, and the portion of third outer surface 337 associated with second fold 364 may face toward second inner surface 314 of second sheet 214 during this stage of manufacture. Similarly, in some embodiments, the portion of fourth outer surface 339 associated with third fold 366 may also face toward first inner surface 312 of first sheet 212, and the portion of fourth outer surface 339 associated with fourth fold 368 may also face toward second inner surface 314 of second sheet 214 during this stage of manufacture. In other words, the outer surface of the interior sheets (i.e., first folded sheet 236 and second folded sheet 238) can be arranged to face the inner surfaces of the exterior sheets (i.e., first sheet 212 and second sheet 214) in different embodiments.

In addition, as shown in FIG. 3, in some embodiments, the portion of third inner surface 336 associated with first fold 362 and the portion of third inner surface 336 associated with second fold 364 may generally face toward each other during this stage of manufacture. Similarly, the portion of fourth inner surface 338 associated with third fold 366 and the portion of fourth inner surface 338 associated with fourth fold 368 may generally face toward each other during this stage of manufacture.

Furthermore, in some embodiments, as shown in FIGS. 2 and 3, during manufacture, a first upper edge 372 of first sheet 212, a second upper edge 374 of second sheet 214, a third upper edge 376 of first folded sheet 236, and a fourth upper edge 378 of first folded sheet 236 can be substantially aligned. Similarly, in some embodiments, during manufacture, a first lower edge 382 of first sheet 212, a second lower edge 384 of second sheet 214, a third lower edge 386 of second folded sheet 238, and a fourth lower edge 388 of second folded sheet 238 can be substantially aligned. Thus, in one embodiment, the method of manufacture can include positioning the fourth upper edge adjacent to and parallel to the first upper edge, as well as positioning the fourth lower edge adjacent to and parallel to the first lower edge. Furthermore, the sheets can be arranged such that the first upper edge abuts the third upper edge and the second upper edge abuts the fourth upper edge. Similarly, the first lower edge can be arranged to abut the third lower edge and the second lower edge to abut the fourth lower edge. It should be understood that each of first upper edge 372 of first sheet 212, second upper edge 374 of second sheet 214, third upper edge 376 of first folded sheet 236, and fourth upper edge 378 of first folded sheet 236 can be aligned with respect to longitudinal axis 380. Similarly, first lower edge 382 of first sheet 212, second lower edge 384 of second sheet 214, third lower edge 386 of second folded sheet 238, and fourth lower edge 388 of second folded sheet 238 can be substantially aligned with respect to longitudinal axis 380.

In different embodiments, the sheets utilized in the manufacture of the steaming apparatus can include provisions for facilitating the particular configuration of welds and/or attachment regions for the sheets. In some embodiments, the material composition of the different surface sides of each sheet can differ. In some embodiments, the sheet can have one side that includes a first material composition, and a second (opposite facing) side that includes a second material composition that differs from the first material composition. For example, in some embodiments, one side can comprise a heat-weldable material, while the opposite-facing side of the same sheet comprises a material resistant to welding. In certain embodiments, the sheets may be formed of a lamination of polyester and polyethylene, since polyester has a much higher melt temperature than polyethylene. The lamination may also include a stiffening layer, formed of nylon, for example.

However, it should be understood that in other embodiments, both sides of a sheet can have substantially similar material compositions. For example, in some embodiments, the sheets can be substantially similar and have a generally uniform composition. In other embodiments, a weld resistant or insulating material or plate may be inserted between two surfaces that can prevent the welding together of the two surfaces. For example, an insulating material may be inserted between a first fold portion and a second fold portion of the first folded sheet in one embodiment. In another embodiment, one side of a sheet may be coated with a heat-weldable material or have a heat-weldable material applied to a surface of the sheet including, but not limited to, thermoplastic materials such as polyethylene, polypropylene, polyamide, or polyesters. In another embodiment, one surface side of a sheet may be coated with a non-adhering material including, but not limited to, Teflon™ or silicone, prior to the welding process. Thus, in different embodiments, the response of each surface side of a sheet to increased temperature can vary according to the material composition or the treatment that may have been applied to the surface. Embodiments of welding of the sheets will be discussed below with respect to FIGS. 4 and 8.

Figure 4:
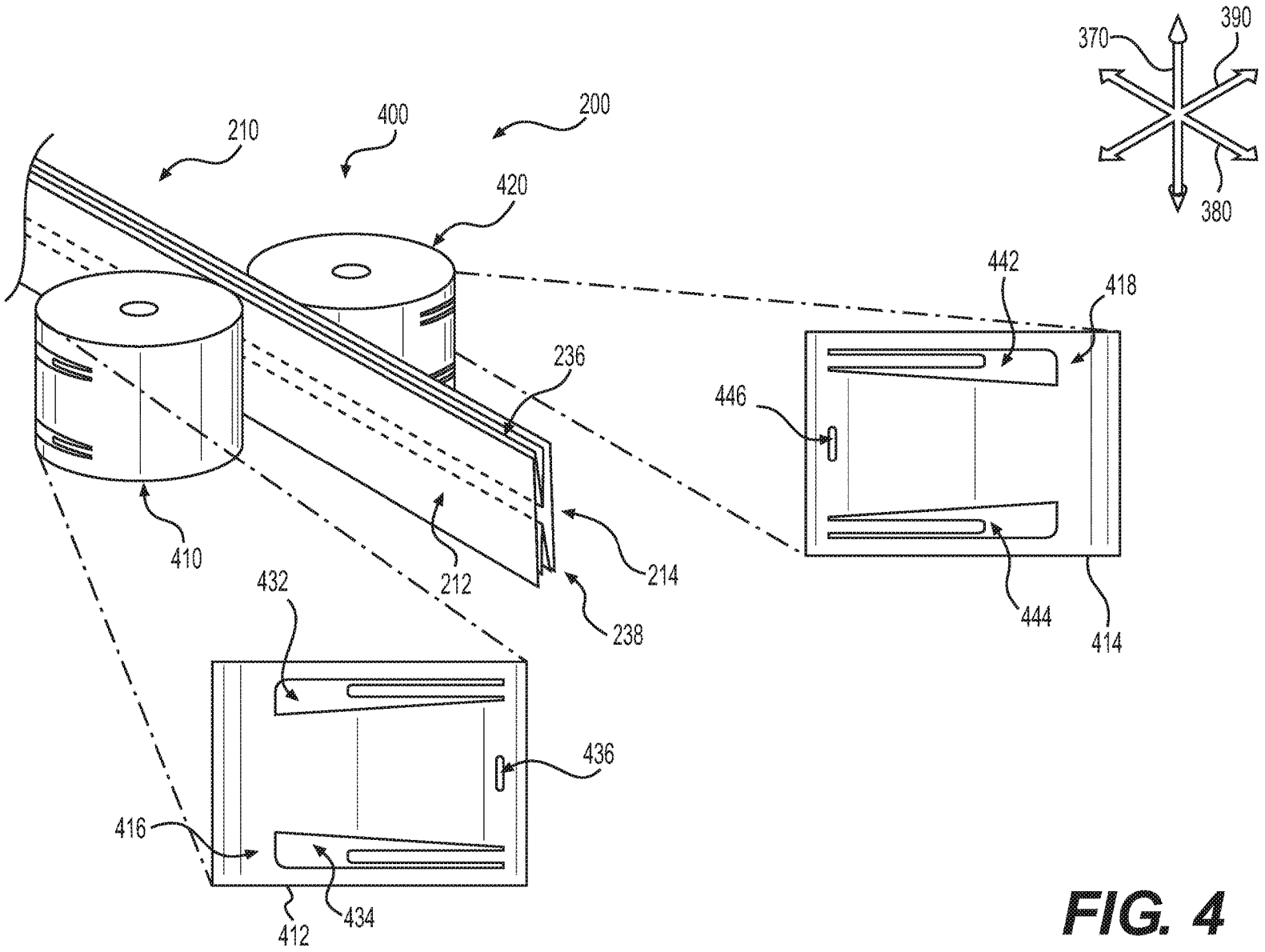
FIG. 4 is an isometric view of an embodiment of a manufacturing assembly with a welding system.

Manufacturing assembly 200 may include provisions for fixedly joining, attaching, or connecting various portions of two or more sheets in different embodiments, for example, with adhesive(s), stitching, thermoplastic bonding, welding, or other suitable techniques. Referring to FIG. 4, an embodiment of the first welding step is illustrated. A portion of manufacturing assembly 200 is shown with a first welding system 400. First welding system 400 can include different components in different embodiments. In one embodiment, first welding system 400 includes a first cylinder 410 and a second cylinder 420. The cylinders may be alternatively referred to as rollers in this description. In other embodiments there may be a greater number, a fewer number, or no cylinders and another welding means known to persons of ordinary skill in the art of welding may be utilized. Furthermore, in some embodiments, the different welding steps described herein may be replaced or supplemented by the application of adhesives or other types of connecting materials.

In some embodiments, as sheets 210 move or travel between the two cylinders, various portions of the sheets may be welded together. In one embodiment, a particular weld pattern can be included on one or both of the cylinders. The weld pattern can comprise heated and/or raised portions of the cylinders in different embodiments. In some embodiments, as layered sheet set 250 enters the welding region of manufacturing assembly 200, it may be heated and/or pressed to form a weld with a pattern corresponding to the raised surfaces on each cylinder. For purposes of clarity, FIG. 4 also includes a first flattened view 412, in which the outer curved surface of first cylinder 410 is depicted in an unrolled or flattened configuration. In first flattened view 412, a first weld pattern 416 can be seen, where first weld pattern 416 includes a first weld segment 432, a second weld segment 434, and a third weld segment 436. In other embodiments, there may be fewer or more weld segments. In different embodiments, each weld segment can vary in shape and size from other weld segments. In FIG. 4, first weld segment 432 and second weld segment 434 are substantially mirror images of each other, while third weld segment 436 differs significantly from either of first weld segment 432 and second weld segment 434.

In addition, FIG. 4 has a second flattened view 414, in which the outer curved surface of second cylinder 420 is depicted in an unrolled or flattened configuration. Though in some embodiments the weld segments formed on second cylinder 420 can differ from that of first cylinder 410, in one embodiment, they can also be substantially similar. In FIG. 4, it can be seen that second cylinder 420 has a fourth weld segment 442 that is substantially similar to first weld segment 432, a fifth weld segment 444 that is substantially similar to second weld segment 434, and a sixth weld segment 446 that is substantially similar to third weld segment 436. In other words, in some embodiments, first weld pattern 416 can be substantially similar to a second weld pattern 418 (comprising fourth weld segment 442, fifth weld segment 444, and sixth weld segment 446) on second cylinder 420. In one embodiment, first cylinder 410 includes a weld pattern that is a mirror image of the weld pattern of second cylinder 420. Furthermore, first cylinder 410 and second cylinder 420 can operate together to form a matching or "front" and "rear" welding application that securely joins together portions of layered sheet set 250. In other embodiments, however, only one cylinder or surface may include a weld pattern, while a second cylinder or surface may be utilized to provide pressure during the welding process.

Figure 5:
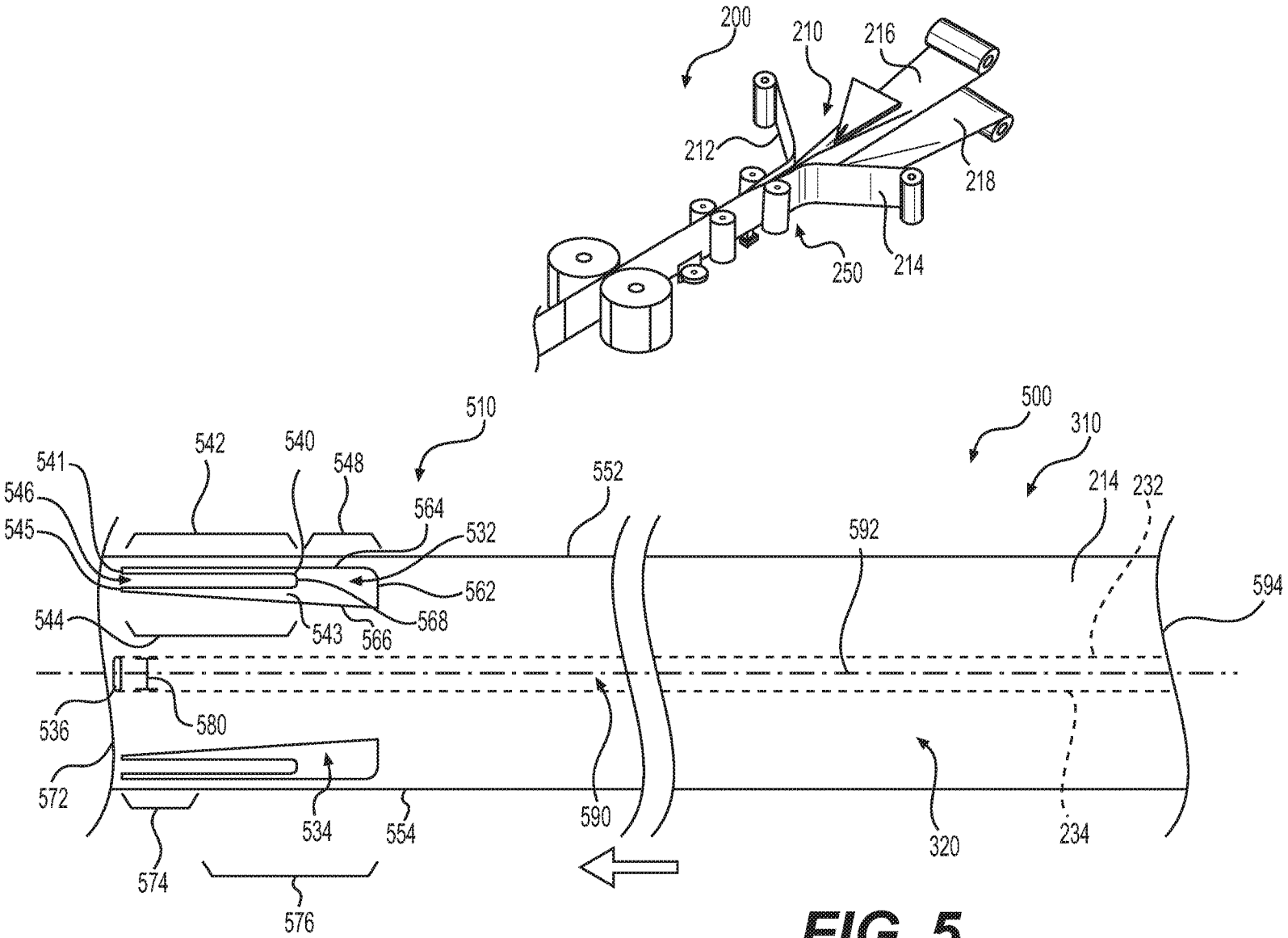
FIG. 5 is an embodiment of a portion of a manufacturing assembly with a welding step.

As shown in FIG. 5, once sheets 210 emerge from between the welding cylinders, portions of layered sheet set 250 may include welds corresponding to the weld patterns depicted in FIG. 4. For purposes of clarity, two portions of sheets 210 are depicted with detail in FIG. 5, including a pre-weld portion 500 and a post-weld portion 510. In pre-weld portion 500, sheets 210 have a generally uniform outer surface. In post-weld portion 510, however, it can be seen that three welds have been formed corresponding generally to the first weld pattern of FIG. 4, including a first weld portion ("first weld") 532, a second weld portion ("second weld") 534, and a third weld portion ("third weld") 536. It can be understood that first weld 532, second weld 534, and third weld 536 can extend through at least a portion of the thickness of layered sheet set 250 in some embodiments, such that the welds join together the areas associated with each of the layers of sheets included in the welded portion.

In addition, while FIGS. 4-9 present only one side of sheets 210 for purposes of clarity, it should be understood that the opposite side of sheets 210 are also welded in a substantially similar manner and arrangement. In other words, as three welds are formed along first sheet 212, two welds are also formed along second sheet 214. In one embodiment, first weld 532 joins a portion of first sheet 212 with a portion of first folded sheet 236 and second weld 534 joins a portion of first sheet 212 with a portion of second folded sheet 238 (see FIG. 2), while third weld 536 joins a portion of first sheet 212 with a portion of second sheet 214. In addition, though not shown here, two additional welds are associated with the opposite side of the sheets, such that one weld (substantially identical to first weld 532) joins a portion of second sheet 214 with a portion of first folded sheet 236 and another weld (substantially identical to second weld 534) joins a portion of second sheet 214 with a portion of second folded sheet 238. Thus, in some embodiments, five distinct welds can be formed during the first welding step. This arrangement will be discussed in greater detail with respect to FIG. 10 below.

Furthermore, referring to FIGS. 4 and 5, it can be seen that first weld 532 has a shape and size substantially similar to that of first weld segment 432, second weld 534 has a shape and size substantially similar to that of second weld segment 434, and third weld 536 has a shape and size substantially similar to that of third weld segment 436. For purposes of reference, each of first weld 532 and second weld 534 can be understood to include different regions, where each region can have a particular shape and/or arrangement. Though these regions will be discussed primarily with respect to first weld 532, it will be understood that these terms may be applied herein to the description of second weld 534 in different embodiments.

For example, in FIG. 5, first weld 532 comprises a first elongated portion 542, a first corner portion 548, and a second elongated portion 544. Together, first elongated portion 542, first corner portion 548, and second elongated portion 544 can provide a two-pronged shape that partly bounds a non-welded region (herein referred to as a first elongated channel portion ("channel portion") 546, as will be discussed below). First elongated portion 542 extends from a first end 540—joined to first corner portion 548—to a second end 541 that is a free end. Similarly, second elongated portion 544 extends from a third end 543—joined to first corner portion 548—to a fourth end 545 that is a free end. In some embodiments, first elongated portion 542 is substantially similar in size and shape and/or area as second elongated portion 544. However, in other embodiments, there may be differences between first elongated portion 542 and second elongated portion 544. In FIG. 5, first elongated portion 542 has an elongated rectangular shape, such that it begins at first end 540 and continues with a generally consistent width until it terminates at second end 541. In addition, second elongated portion 544 has an elongated triangular shape, such that it begins at third end 543 and tapers or narrows as it approaches fourth end 545. In some embodiments, fourth end 545 can be a pointed end or a rounded tapered end. In one embodiment, the width associated with first end 540 can be smaller than the width associated with third end 543.

Furthermore, as shown in FIG. 5, first corner portion 548 generally may include a four-sided shape in some embodiments, comprising a first corner edge 562, a second corner edge 564, a third corner edge 566, and a fourth corner edge 568. Second corner edge 564 and third corner edge 566 may be substantially parallel with respect to one another in some embodiments, and/or be substantially aligned with lateral axis 390. However, while first corner edge 562 and/or fourth corner edge 568 may be substantially parallel with respect to one another in some embodiments, it can be seen in FIG. 5 that in one embodiment, while first corner edge 562 is substantially aligned with longitudinal axis 380, fourth corner edge 568 is diagonal relative to longitudinal axis 380, such that first corner edge 562 and fourth corner edge 568 are nonparallel. In other embodiments, first elongated portion 542, second elongated portion 544, and first corner portion 548 can have any other shape including rectangular, square, oblong, triangular, trapezoidal, or any regular or irregular shape.

As noted above, in some embodiments, the shape of first weld 532 can at least partly bound first elongated channel portion 546, where first elongated channel portion 546 comprises a portion of sheets 210 that are non-welded or unattached to an adjacent sheet. In one embodiment, first elongated channel portion 546 may be bounded on two longitudinal sides by first elongated portion 542 and second elongated portion 544, and along a top laterally oriented side by first corner portion 548. Thus, in some embodiments, a bottom side of first elongated channel portion 546 can provide an open or entryway into the channel, and/or can be capable of receiving an element, as will be discussed further below.

In some embodiments, third weld 536 includes a region that is substantially smaller in area relative to either first weld 532 or second weld 534. For example, in FIG. 5, it can be seen that third weld 536 comprises a first weld width 580 that is substantially similar to central width 394 (see FIG. 3) as it can lie in a region that extends between first longitudinal midline 232 and second longitudinal midline 234. In one embodiment, third weld 536 has a generally narrow, rectangular, or oblong rectangular shape, though in other embodiments, third weld 536 may comprise any other shape including rectangular, square, oblong, triangular, trapezoidal, or any regular or irregular shape.

In addition, the arrangement of each weld portion along layered sheet set may vary in different embodiments. For example, first weld 532 is disposed along or associated with a peripheral border of layered sheet set 250, adjacent to (or abutting) a first edge 552 of layered sheet set 250, where first edge 552 is substantially aligned with longitudinal axis 380. Similarly, second weld 534 is disposed along or associated with a peripheral border of layered sheet set 250, adjacent to (or abutting) a second edge 554 of layered sheet set 250, where second edge 554 is substantially aligned with longitudinal axis 380. Furthermore, third weld 536 is disposed along or associated with a peripheral border of layered sheet set 250, adjacent to (or abutting) a third edge 572 of layered sheet set 250, where third edge 572 is substantially aligned with lateral axis 390. In addition, third edge 572 may be understood to be positioned nearer to a bottom portion 574 of layered sheet set 250 than to an upper portion 576 of layered sheet set 250. Third weld 536 may also be disposed in a central region 590 of layered sheet set 250, extending between first longitudinal midline 232 and second longitudinal midline 234. Thus, in one embodiment, the arrangement of welds in layered sheet set 250 can produce a substantially symmetrical pattern relative to a central midline 592 that extends in a lateral direction from third edge 572 to a fourth edge 594.

Figure 6:
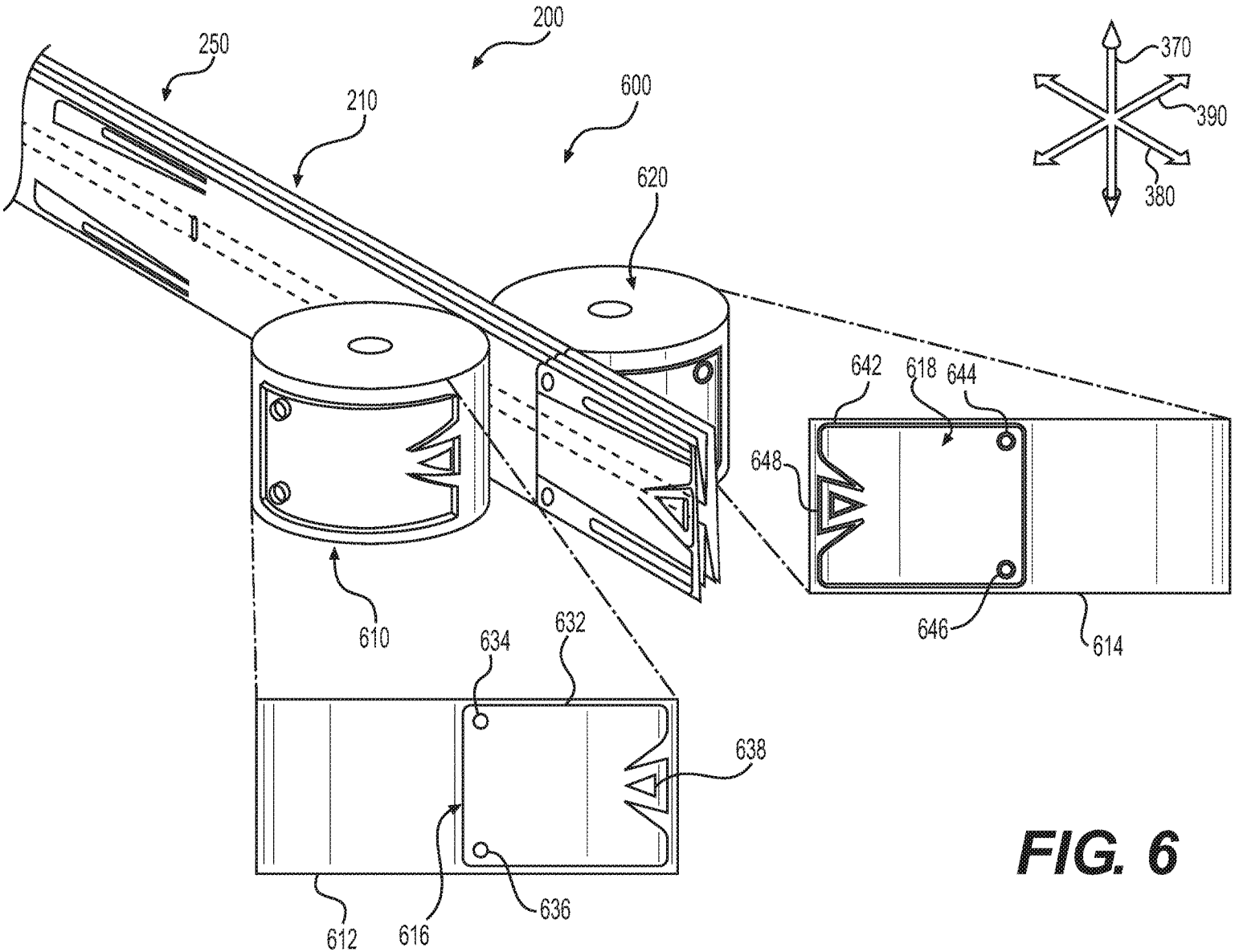
FIG. 6 is an isometric view of an embodiment of a manufacturing assembly with a cutting system.

In some embodiments, manufacturing assembly 200 may also include provisions for removing, isolating, cutting, or otherwise separating portions of sheets 210 from layered sheet set 250. Referring to FIG. 6, an embodiment of a cutting step is illustrated. A portion of manufacturing assembly 200 is shown with a cutting system 600. Cutting system 600 can include different components in different embodiments. In one embodiment, cutting system 600 includes a third cylinder 610 and a fourth cylinder 620. The cylinders may be alternatively referred to as rollers in this description. In other embodiments there may be a greater number, a fewer number, or no cylinders and another cutting means known to persons of ordinary skill in the art of cutting may be utilized. Furthermore, in some embodiments, the different cutting steps described herein may be replaced or supplemented by the application of blades or laser cutting, or other types of separation devices may be utilized.

In some embodiments, as sheets 210 move or travel between the two cutting cylinders, various portions of the sheets may be cut or sliced through. In one embodiment, a particular cut pattern can be included on one or both of the cylinders. In some embodiments, as layered sheet set 250 enters the cutting system region of manufacturing assembly 200, it may be incised and/or cut to form a pattern corresponding to the raised surfaces on one of the cylinders. For purposes of clarity, FIG. 6 also includes a third flattened view 612, in which the outer curved surface of third cylinder 610 is depicted in an unrolled or flattened configuration. In third flattened view 612, a cut pattern 616 can be seen, where cut pattern 616 includes first raised segment 632, a second raised segment 634, a third raised segment 636, and a fourth raised segment 638. In other embodiments, there may be fewer or more raised segments. In different embodiments, each raised segment can vary in shape and size from other weld segments. In FIG. 6, second raised segment 634 and third raised segment 636 are substantially similar, while first raised segment 632 and fourth raised segment 638 differ significantly from the other raised segments in cut pattern 616. In addition, it can be understood that raised segments can be substantially thin or narrow raised portions of the cylinder, allowing cut pattern 616 to readily cut through the thickness comprising the stacked layers of layered sheet set 250.

In addition, FIG. 6 has a fourth flattened view 614, in which the outer curved surface of fourth cylinder 620 is depicted in an unrolled or flattened configuration. In different embodiments, fourth cylinder 620 can include one or more recessed segments. In some embodiments, recessed segments can be configured to receive or allow for the enveloping of portions of raised segments on a cylinder or surface disposed opposite to the recessed segments, as well as a means of providing a support framework to layered sheet set 250 during the cutting process. Though in some embodiments the arrangement of raised segments formed on third cylinder 610 can differ from the arrangement of recessed segments of fourth cylinder 620, in some embodiments, they may be substantially similar. In FIG. 6, it can be seen that fourth cylinder 620 has a first recessed segment 642 that is substantially similar in shape to first raised segment 632, a second recessed segment 644 that is substantially similar in shape to second raised segment 634, a third recessed segment 646 that is substantially similar in shape to third raised segment 636, and a fourth recessed segment 648 that is substantially similar in shape to fourth raised segment 638. In other words, in some embodiments, cut pattern 616 can be substantially similar to a recess pattern 618 (comprising first recessed segment 642, second recessed segment 644, third recessed segment 646, and fourth recessed segment 648). In one embodiment, third cylinder 610 includes a cut pattern that is a mirror image of the recess pattern of fourth cylinder 620. Furthermore, third cylinder 610 and fourth cylinder 620 can operate together to form a matching or "front" and "rear" cut and receive application that cuts through portions of layered sheet set 250. In other embodiments, however, more than one cylinder or surface may include a cut pattern, and two or more cylinders or surfaces may be utilized to provide a receiving recess for the raised cutting segments during the cutting process.

Figure 7:
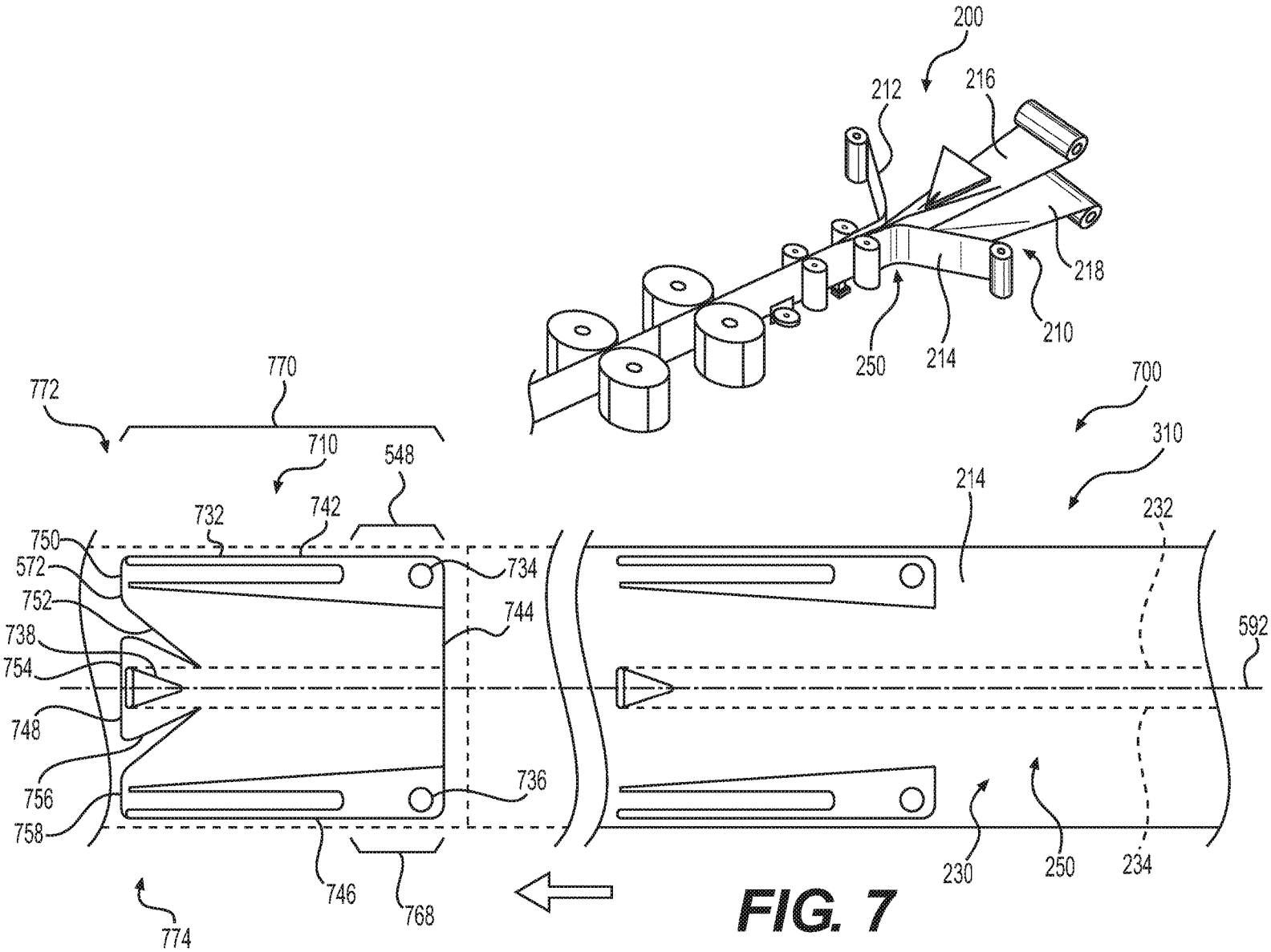
FIG. 7 is an embodiment of a portion of a manufacturing assembly with a cutting step.

As shown in FIG. 7, once sheets 210 emerge from between the cutting cylinders, portions of layered sheet set 250 may include cut or incised regions corresponding to the cut pattern depicted in FIG. 6. For purposes of reference, once layered sheet set 250 has been cut to form an outline of the resultant steaming bag, the portion that will be removed and is bounded by the cut pattern may be referred to as a "layered panel set." For purposes of clarity, two portions of sheets 210 are depicted with detail in FIG. 7, including a pre-cut portion 700 and a post-cut portion 710. In pre-cut portion 700, sheets 210 in layered sheet set 250 are generally continuous. In post-cut portion 710, however, it can be seen that four cuts have been formed corresponding generally to the cut pattern of FIG. 6, including a first cut portion ("first cut") 732, a second cut portion ("second cut") 734, a third cut portion ("third cut") 736, and a fourth cut portion ("fourth cut") 738, resulting in a layered panel set 770. It can be understood that first cut 732, second cut 734, third cut 736, and fourth cut 738 can extend through at least a portion of the thickness of layered sheet set 250 in some embodiments, such that the cuts completely separate the regions associated with either side of the cuts, providing the borders associated with layered panel set 770 that has been delineated within layered sheet set 250.

Furthermore, referring to FIGS. 6 and 7, it can be seen that first cut 732 has a shape and size substantially similar to that of first raised segment 632, second cut 734 has a shape and size substantially similar to that of second raised segment 634, third cut 736 has a shape and size substantially similar to that of third raised segment 636, and fourth cut 738 has a shape and size substantially similar to that of fourth raised segment 638.

For purposes of reference, first cut 732 can be understood to include different regions, where each region can have a particular shape and/or arrangement. In FIG. 7, first cut 732 comprises a first cut edge 742, a second cut edge 744, a third cut edge 746, and a fourth cut edge 748. In some embodiments, first cut edge 742, second cut edge 744, and/or third cut edge 746 can be substantially linear. However, in some embodiments, there may also be portions (such as corner regions) that are curved associated with each cut. Furthermore, in some embodiments, first cut edge 742 may be substantially parallel with respect to third cut edge 746, and can be substantially aligned with longitudinal axis 380. In addition, second cut edge 744 may extend between first cut edge 742 and third cut edge 746, and can be substantially aligned with lateral axis 390 in some embodiments. While fourth cut edge 748 may also be generally linear in different embodiments, fourth cut edge 748 may comprise differently arranged sections in some embodiments. For example, in FIG. 7, fourth cut edge 748 includes a first bottom cut 750, a second bottom cut 752, a third bottom cut 754, a fourth bottom cut 756, and a fifth bottom cut 758. Together, first bottom cut 750, a second bottom cut 752, a third bottom cut 754, a fourth bottom cut 756, and a fifth bottom cut 758 can provide a particular shape that defines a bottom portion of the steaming bag (as will be discussed further below).

In FIG. 7, first bottom cut 750 extends from a third side 772 of layered panel set 770 toward central midline 592, and joins second bottom cut 752. A fourth side 774 is also disposed opposite of third side 772. Second bottom cut 752 has an elongated triangular shape, such that it begins near third edge 572 with a first width and tapers or narrows as it extends toward a tapered end near first longitudinal midline 232, until the width approaches zero. In addition, it can be seen that second bottom cut 752 is arranged such that the shape is substantially diagonal, extending inward (i.e., toward the center) from an outer end. In some embodiments, the tapered end can be a pointed end or a rounded tapered end.

Third bottom cut 754 extends from second bottom cut 752 in a substantially linear manner, and is generally aligned with first bottom cut 750. In one embodiment, fourth bottom cut 756 can be substantially similar in size and shape to second bottom cut 752. In some embodiments, fourth bottom cut 756 and second bottom cut 752 can be mirror images of each other. Thus, fourth bottom cut 756 also has an elongated triangular shape, such that it begins near third edge 572 with a first width and tapers or narrows as it extends toward a tapered end near second longitudinal midline 234, until the width approaches zero. In addition, it can be seen that fourth bottom cut 756 is arranged such that the shape is substantially diagonal, extending inward (i.e., toward the center) from an outer end. In some embodiments, the tapered end can be a pointed end or a rounded tapered end. Thus, in one embodiment, a first portion of the bottom portion and a second portion of the bottom portion may be cut to help form a space between the base portion and a body portion of the steaming bag (see FIG. 10). Finally, fifth bottom cut 758 extends outward in a generally linear manner from fourth bottom cut 756 until it intersects with third cut edge 746, and can be aligned with first bottom cut 750 and third bottom cut 754 in different embodiments.

Furthermore, as shown in FIG. 7, second cut 734 and third cut 736 can be substantially similar in size and shape in different embodiments. In FIG. 7, each of second cut 734 and third cut 736 comprise a substantially round shape. In addition, in some embodiments, second cut 734 may be located within the region associated with the welded first corner portion 548 and third cut 736 may be located within the region associated with a welded second corner portion 768. Fourth cut 738 can comprise a substantially triangular shape located near the center of a bottom portion of layered panel set 770. In addition, in some embodiments, fourth cut 738 comprises a substantially triangular-shaped portion that is cut from the bottom portion of the layered panel set to form an aperture in the base portion (see FIGS. 10 and 12). However, in other embodiments, one or more of second cut 734, third cut 736, or fourth cut 738 may comprise any shape, including a round, square, elliptical, oval, rectangular, triangular, pentagonal, hexagonal, or any other regular or irregular shape.

Thus, as will be shown below in FIG. 10, in one embodiment, the various cuts described herein can result in the cutting of a first panel from the first sheet, the cutting of a second panel from the second sheet, the cutting of a third panel from the third sheet, and the cutting of a fourth panel from a fourth sheet to facilitate removal of a layered panel set from the layered sheet set.

Figure 8:
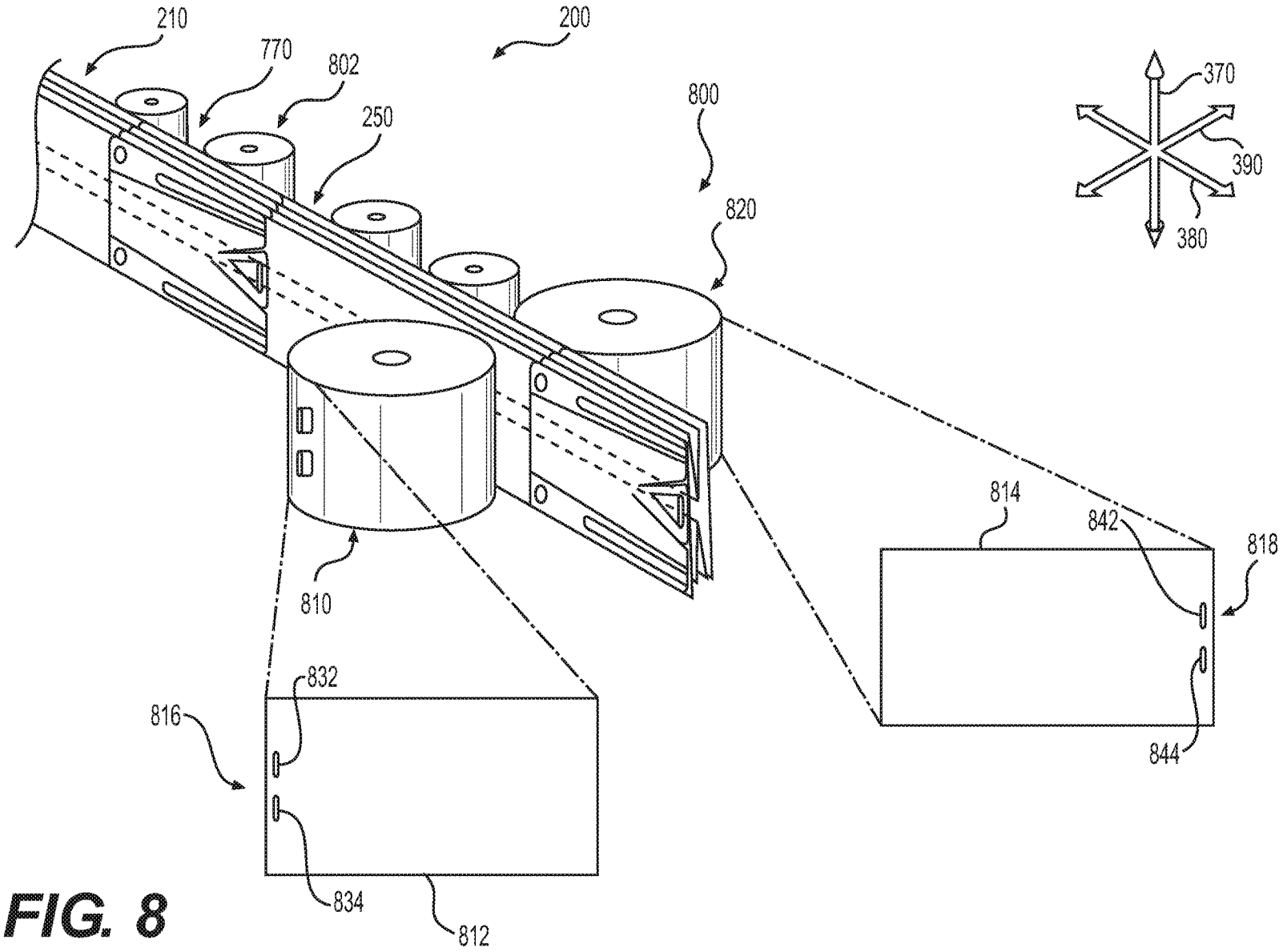
FIG. 8 is an isometric view of an embodiment of a manufacturing assembly with a welding system.

Referring now to FIG. 8, as sheets 210 are routed toward a second welding step, it can be understood that manufacturing assembly 200 can include provisions for maintaining the overall flattened layered panel set 770 within the structure of layered sheet set 250. In other words, though sheets 210 have been cut (as depicted in FIGS. 6 and 7), there may not yet be a removal of any portion of sheets (such as the layered panel set) from the set of layered sheets in some embodiments. In some embodiments, for example, manufacturing assembly 200 can include a plurality of feed rollers ("feed rollers") 802. Feed rollers 802 can be configured to facilitate the travel of sheets 210 through manufacturing assembly 200 by maintaining the flattened, smooth state illustrated in the figures. In some embodiments, feed rollers 802 (depicted along only one side of manufacturing assembly 200 in FIG. 8 to allow a better view of sheets 210 to the reader) can help move the sheets through certain parts of the assembly by rotating and pushing the sheets forward, and/or they can apply a force along the outer sides of the sheets to ensure the entirety of the layered sheets continues to move through the assembly. However, in other embodiments, manufacturing assembly 200 can include other provisions for maintaining the smooth and continuous travel of sheets 210 through the various systems or components described herein. Furthermore, though not illustrated earlier, it should be understood that feed rollers 802 or similar provisions may be utilized throughout any portion of manufacturing assembly 200.

Referring to FIG. 8, an embodiment of the second welding step is illustrated. A portion of manufacturing assembly 200 is shown with a second welding system 800. Second welding system 800 can include different components in different embodiments. In one embodiment, second welding system 800 includes a fifth cylinder 810 and a sixth cylinder 820. The cylinders may be alternatively referred to as rollers in this description. In other embodiments there may be a greater number, a fewer number, or no cylinders and another welding means known to persons of ordinary skill in the art of welding may be utilized. Furthermore, in some embodiments, the welding process described herein may be replaced or supplemented by the application of adhesives or other types of connecting materials.

As noted above, in some embodiments, as sheets 210 move or travel between the two cylinders, various portions of the sheets may be welded together. In one embodiment, a particular weld pattern can be included on one or both of the cylinders. The weld pattern can comprise heated and/or raised portions of the cylinders in different embodiments. In some embodiments, as layered panel set 770 enters the next welding region of manufacturing assembly 200, it may be heated and/or pressed to form a weld with a pattern corresponding to the raised surfaces on each cylinder. For purposes of clarity, FIG. 8 also includes a fifth flattened view 812, in which the outer curved surface of fifth cylinder 810 is depicted in an unrolled or flattened configuration. In fifth flattened view 812, a third weld pattern 816 can be seen, where third weld pattern 816 includes a seventh weld segment 832 and an eighth weld segment 834. In other embodiments, there may be fewer or more weld segments in a weld pattern. In different embodiments, each weld segment can vary in shape and size from other weld segments. In FIG. 8, seventh weld segment 832 and eighth weld segment 834 are substantially mirror images of each other, though in other embodiments, they may be shaped or arranged differently.

In addition, FIG. 8 presents a sixth flattened view 814, in which the outer curved surface of sixth cylinder 820 is depicted in an unrolled or flattened configuration. Though in some embodiments the weld segments formed on sixth cylinder 820 can differ from that of fifth cylinder 810, in one embodiment, they can also be substantially similar. In FIG. 8, it can be seen that sixth cylinder 820 has a ninth weld segment 842 that is substantially similar to seventh weld segment 832, and a tenth weld segment 844 that is substantially similar to eighth weld segment 834. In other words, in some embodiments, third weld pattern 816 can be substantially similar to a fourth weld pattern 818 (comprising ninth weld segment 842 and tenth weld segment 844) on sixth cylinder 820. In one embodiment, fifth cylinder 810 can include a weld pattern that is a mirror image of the weld pattern of sixth cylinder 820. Furthermore, fifth cylinder 810 and sixth cylinder 820 can operate together to form a matching or "front" and "rear" welding application that securely joins together portions of layered panel set 770. In other embodiments, however, only one cylinder or surface may include a weld pattern, while a second cylinder or surface may be utilized to provide pressure during the welding process.

Figure 9:
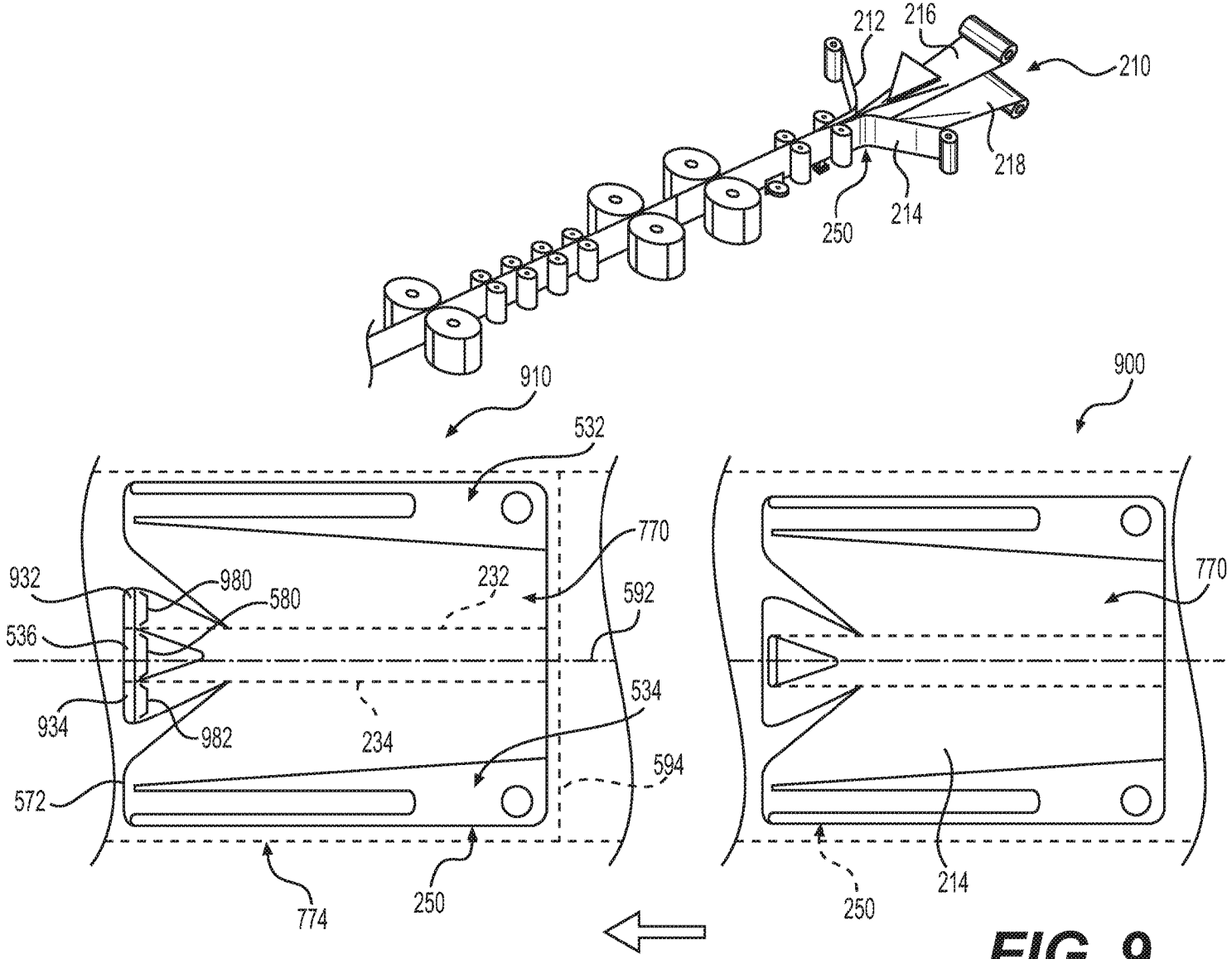
FIG. 9 is an embodiment of a portion of a manufacturing assembly with a welding step.

As shown in FIG. 9, once sheets 210 emerge from between the welding cylinders, portions of layered sheet set 250 may include welds corresponding to the weld patterns depicted in FIG. 8. For purposes of clarity, two portions of sheets 210 are depicted with detail in FIG. 9, including a pre-weld portion 900 and a post-weld portion 910. In pre-weld portion 900, sheets 210 have only the welds that were described above with respect to FIGS. 4 and 5. In post-weld portion 910, however, it can be seen that two additional welds have been formed corresponding generally to the fifth weld pattern shown in FIG. 8, including a fourth weld portion ("fourth weld") 932 and a fifth weld portion ("fifth weld") 934. It can be understood that fourth weld 932 and fifth weld 934 can extend through the thickness of layered panel set 770 in some embodiments, such that the welds join together the areas associated with each of the layers of sheets included in the welded portion.

Furthermore, referring to FIGS. 8 and 9, it can be seen that fourth weld 932 and fifth weld 934 are substantially similar in dimension as third weld 536 in one embodiment. For example, in some embodiments, third weld 536 comprises first weld width 580 that is substantially similar to a fourth weld width 980 of fourth weld 932 and a fifth weld width 982 of fifth weld 934. Furthermore, in some embodiments, fourth weld 932 can be positioned such that it abuts third weld 536 in a direction extending toward third side 772, and fifth weld 934 can be positioned such that it abuts third weld 536 in a direction extending toward a fourth side 774 (disposed opposite of third side 772 in the lateral direction) of layered panel set 770. In addition, in some embodiments, fourth weld 932 and fifth weld 934 each have a generally narrow, rectangular, or oblong rectangular shape, though in other embodiments, fourth weld 932 and fifth weld 934 may each comprise any other shape including rectangular, square, oblong, triangular, trapezoidal, or any regular or irregular shape.

In addition, the arrangement of each weld portion along the layered sheet set may vary in different embodiments. For example, fourth weld 932 and fifth weld 934 are disposed along or associated with a peripheral border of layered sheet set 250, adjacent to (or abutting) a portion of the edge associated with fourth cut 738 (see FIG. 7). Fourth weld 932 may also be disposed closer to first weld 532 than fifth weld 934, and similarly, fifth weld 934 may be disposed closer to second weld 534 than fourth weld 932. In one embodiment, fourth weld 932 can be disposed directly adjacent to first longitudinal midline 232, and fifth weld 934 can be disposed directly adjacent to second longitudinal midline 234. Thus, in one embodiment, the arrangement of welds in layered sheet set 250 can produce a substantially symmetrical pattern relative to central midline 592 that extends in a longitudinal direction from third edge 572 to fourth edge 594. Thus, in one embodiment, as a result of the various welds applied to the sheets as described herein, a base portion may be formed in the steaming apparatus (as will be depicted in FIG. 12).

In different embodiments, once sheets 210 emerge or exit from second welding system 800, a removal step may occur (not shown here). In some embodiments, a portion of the sheets can be removed or separated from the rest of the sheets, as outlined by the cuts formed in sheets 210 described above with respect to FIGS. 6 and 7. In other words, as shown in FIG. 10, layered panel set 770 may be isolated or removed from the remainder of layered sheet set 250, and comprise a steaming apparatus 1000.

As described previously during the manufacturing steps, steaming apparatus 1000 can include a plurality of sheets that have been joined together along various portions and cut to comprise a particular shape. In different embodiments, steaming apparatus 1000 may comprise a substantially elastic or deformable material that can be expanded and collapsed. In one embodiment, steaming apparatus 1000 may be a steaming bag that is configured to enclose or partially envelope an article. In the flattened configuration (illustrated in FIG. 10), steaming apparatus 1000 may have a generally flat or planar geometry, though it should be understood that there may be regions where folds exist between different sections of steaming apparatus 1000 in the folded configuration, such that steaming apparatus 1000 is not entirely flat (associated with first folded sheet 236 and second folded sheet 238, as described in FIG. 2). Furthermore, steaming apparatus 1000 may obtain a three-dimensional geometry when erected and/or be filled with a solid object or fluid, as will be described further below.

The generally flat or two-dimensional shape corresponding to the flattened configuration of steaming apparatus 1000 can vary in different embodiments. In some cases, steaming apparatus 1000 may have a substantially rectangular shape (shown in FIG. 10). In other cases, steaming apparatus 1000 may have an approximately trapezoidal shape. Examples of other shapes for steaming apparatus 1000 include, but are not limited to, rounded shapes, triangular shapes, polygonal shapes, regular shapes, irregular shapes as well as any other kinds of shapes.

Figure 10:
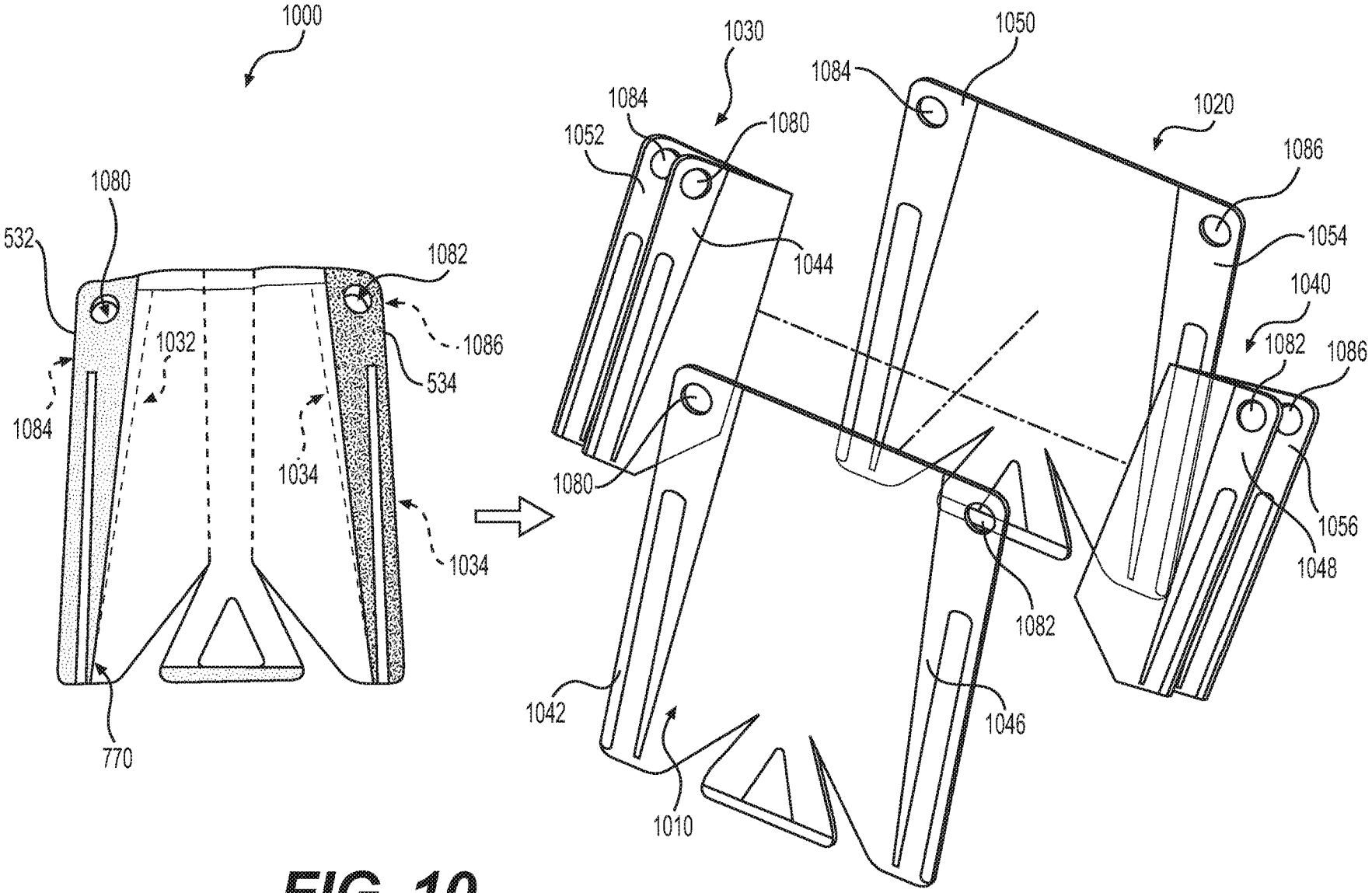
FIG. 10 is an embodiment of a steaming apparatus and an exploded view of the steaming apparatus.

For purposes of reference—shown more clearly in the exploded isometric view provided in FIG. 10—steaming apparatus 1000 includes a first panel 1010, a second panel 1020, a third panel 1030, and a fourth panel 1040. In the present embodiment, steaming apparatus 1000 has two outer panels (comprising first panel 1010 and second panel 1020) that are stacked and joined together. The two outer panels can "sandwich" or cover two additional gusseted (folded) inner panels (comprising third panel 1030 and fourth panel 1040). It should be understood that in different embodiments, steaming apparatus 1000 may include any of the structural features, properties, materials, functions, configurations, and/or characteristics described in Dieter, U.S. patent application Ser. No. 15/053,671, filed Feb. 25, 2016, and entitled "Customization Kit For Articles Of Footwear," the entirety of which is hereby incorporated by reference.

As described earlier, steaming apparatus 1000 can be configured with a plurality of welds. In the exploded view of FIG. 10, it can be seen that the steaming bag as manufactured includes first weld 532, which comprises a first weld region 1042 in first panel 1010 and a second weld region 1044 in third panel 1030. Steaming apparatus 1000 also includes second weld 534, which comprises a third weld region 1046 in first panel 1010 and a fourth weld region 1048 in fourth panel 1040. In addition, it can be seen that steaming apparatus 1000 includes a sixth weld portion ("sixth weld") 1032 and a seventh weld portion ("seventh weld") 1034, where sixth weld 1032 is substantially similar in size, shape, and arrangement to first weld 532 and seventh weld 1034 is substantially similar in size, shape, and arrangement as second weld 534. Thus, sixth weld 1032 comprises a fifth weld region 1050 in second panel 1020 and a sixth weld region 1052 in third panel 1030, and seventh weld 1034 comprises a seventh weld region 1054 in second panel 1020 and an eighth weld region 1056 in fourth panel 1040.

In some embodiments, steaming apparatus 1000 can include additional provisions for facilitating ease of use. In different embodiments, there may be provisions for facilitating contact between steaming apparatus 1000 and a user during use. In some embodiments, steaming apparatus 1000 can include one or more holes that are easily grasped by a user. For example, steaming apparatus 1000 can include holes configured for grasping when steaming apparatus 1000 is in fluid communication with a steam environment or other heat source. It can be seen that at least some of the cuts formed during the cutting step allow the inclusion of a plurality of openings in the different layers of the panels. For example, in the exploded view of FIG. 10, it can be seen that first panel 1010 has a first hole 1080 that is formed in first weld 532, as well as a second hole 1082 that is formed in second weld 534. In addition, second panel 1020 includes a third hole 1084 that is formed in sixth weld 1032, and a fourth hole 1086 that is formed in seventh weld 1034.

Figure 11:
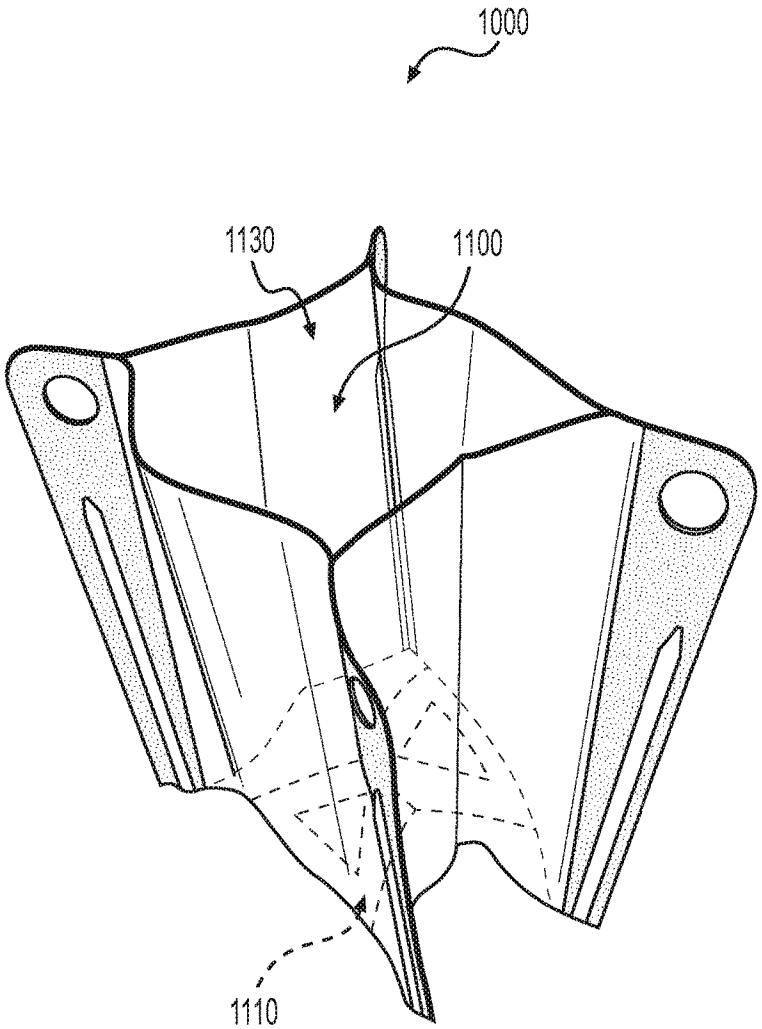
FIG. 11 is an isometric view of an embodiment of a steaming apparatus in the erected configuration.

In different embodiments, steaming apparatus 1000 can include a steaming chamber 1100 that is available for use when the steaming apparatus transitions from the flattened configuration of FIG. 10 to an erected configuration as shown in FIG. 11. In some embodiments, the erected configuration of steaming apparatus 1000 includes a base portion 1110, steaming chamber 1100, and an opening 1130. In some embodiments, base portion 1110 may be configured to be disposed nearer to a steaming device or steam source that is used for creating a steam environment, relative to opening 1130. For example, in embodiments where the steaming device providing steam to the steaming apparatus is a pot, base portion 1110 may be proximate to or contact a bottom interior surface of the pot, while opening 1130 is more distal from the pot. In some cases, steaming chamber 1100 may extend in a generally upward direction from base portion 1110. Furthermore, in the erected configuration, steaming chamber 1100 can extend between base portion 1110 and opening 1130.

Figure 12:
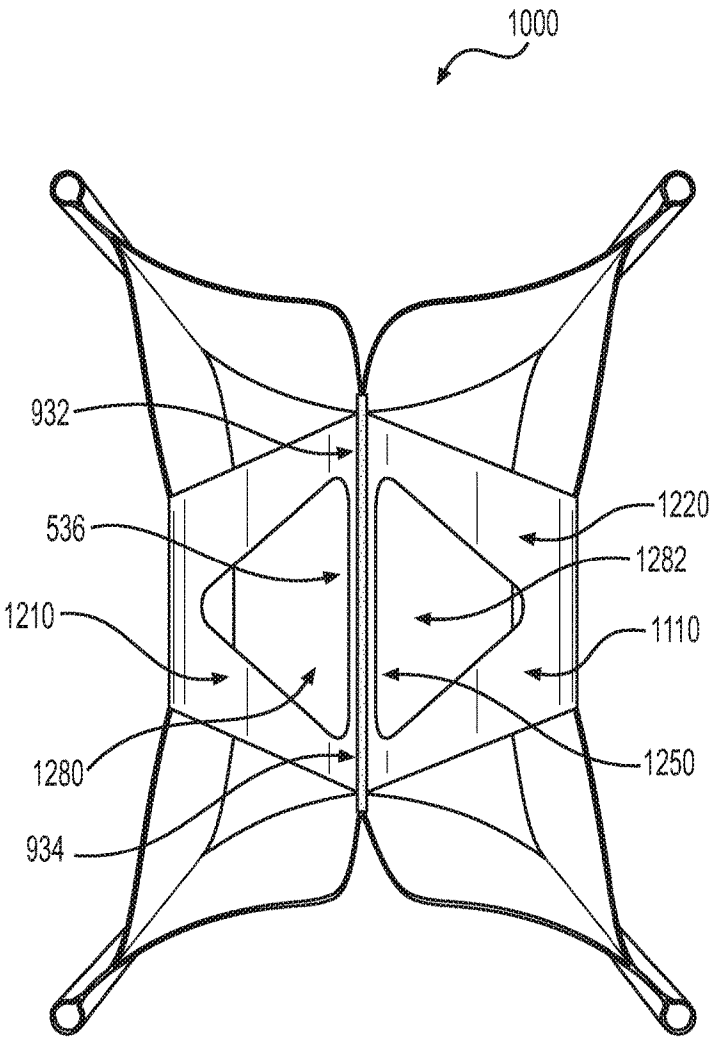
FIG. 12 is a bottom-up view of an embodiment of a steaming apparatus in the erected configuration.

In the bottom-up view of FIG. 12, base portion 1110 of steaming apparatus 1000 is illustrated in the erected configuration. In some embodiments, base portion 1110 may be a substantially folded or collapsed region in the flattened configuration. However, as steaming apparatus 1000 is pulled open and erected, it can be seen that the surface area of base portion 1110 expands and comprises a first base portion 1210 and a second base portion 1220. In other words, when base portion 1110 is in the folded configuration of steaming apparatus 1000, base portion 1110 may comprise a region of substantial contact between an interior-facing surface of first base portion 1210 and an interior-facing surface of second base portion 1220. In some embodiments, first base portion 1210 and second base portion 1220 are substantially similar in size and shape. Thus, in some cases, base portion 1110 can comprise two substantially symmetrical portions that are joined together along third weld 536, fourth weld 932, and fifth weld 934.

In some embodiments, base portion 1110 can correspond to or provide a bottom surface of steaming chamber 1100. In addition, in different embodiments, steaming chamber 1100 includes provisions for permitting the entry or movement of steam into steaming chamber 1100. In FIG. 12, it can be seen that the bottom of steaming chamber 1100 can include a plurality of apertures 1250. Specifically, as noted earlier, base portion 1110 includes a first aperture 1280 located within first base portion 1210 and a second aperture 1282 located within second base portion 1220. In the flattened configuration, the apertures were substantially continuous and formed through a single cut (i.e., fourth cut 738 in FIG. 7) through the thickness of the stacked layers comprising the base portion. However, in the erected configuration shown in FIG. 12, where base portion 1110 has expanded in area and unfolded into two distinct base portions, it can be seen that the single cut may result in two distinct apertures.

Figure 13:
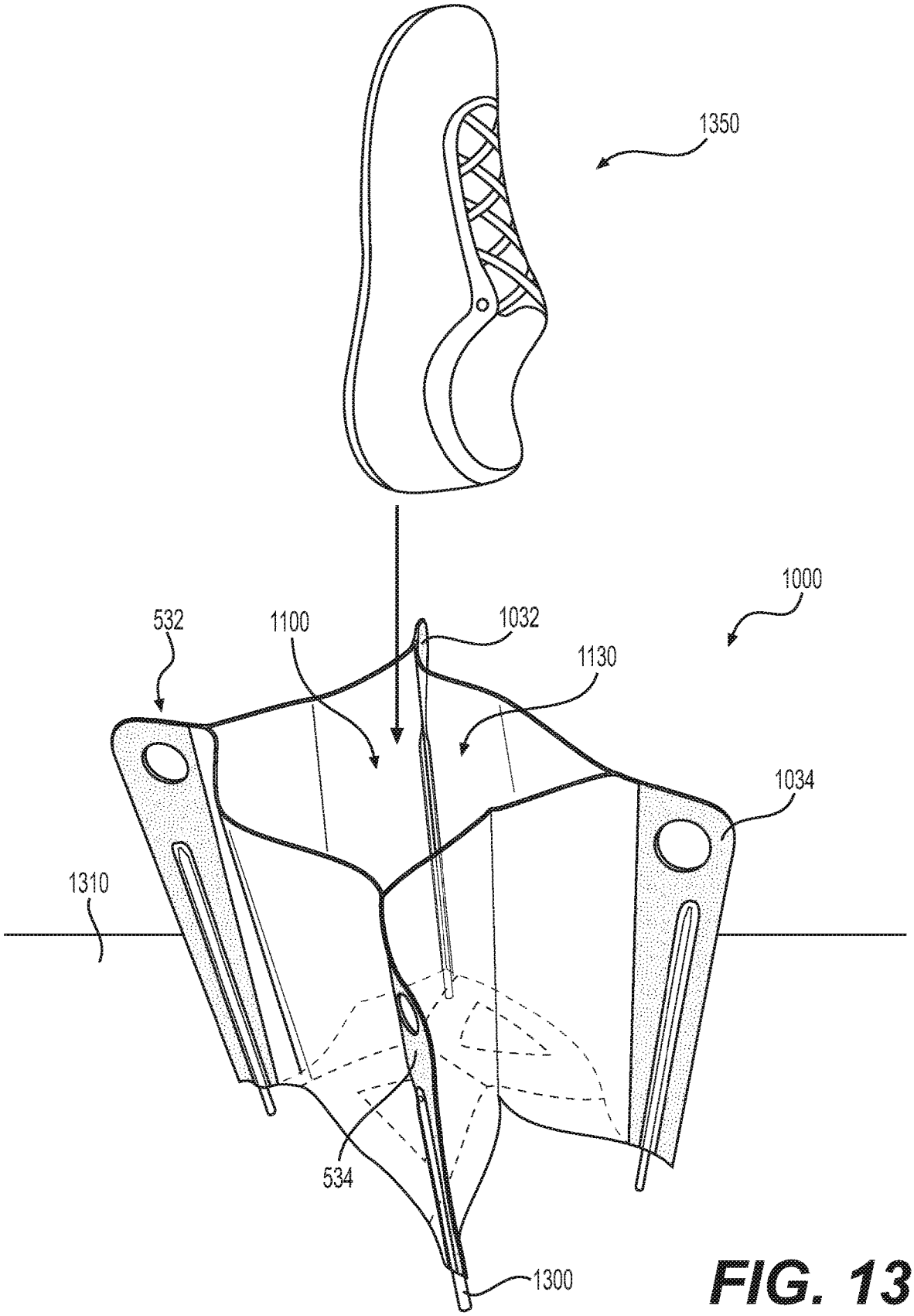
FIG. 13 is an isometric view of an embodiment of a steaming apparatus and an article of footwear.

In some embodiments, the erected configuration of steaming apparatus 1000 may provide a substantially stable structure. In other words, steaming apparatus 1000 may be able to stand independently on a surface in some embodiments. For example, as shown in FIG. 13, a plurality of elongated elements 1300 extend from the channel portions formed in each of first weld 532, second weld 534, sixth weld 1032, and seventh weld 1034 (see, for example, first elongated channel portion 546 described in FIG. 5). There can be four elongated elements inserted within the channel portions formed in each of the corner welded portions of steaming apparatus 1000 in some embodiments. In one embodiment, this arrangement can allow steaming apparatus 1000 to stand on a surface 1310 in the erected state. Furthermore, plurality of elongated elements 1300 allow the majority of the steaming apparatus and the steaming chamber to be raised above surface 1310.

In different embodiments, as steaming apparatus 1000 is pulled open and erected, it can be seen that opening 1130 and/or the resultant steaming chamber 1100 may be sized and dimensioned to receive an article, such as an article of footwear. In FIG. 13, an isometric view of an erected steaming apparatus 1000 is depicted with opening 1130 positioned adjacent to an article of footwear ("article") 1350. Article 1350 is shown directly above steaming apparatus 1000, in a step prior to insertion of the article within steaming chamber 1100. It can be understood that article 1350 may be inserted into steaming chamber 1100 of steaming apparatus 1000 for use with steaming apparatus 1000. In different embodiments, due to the configuration of steaming chamber 1100, different portions of article 1350 can be located within the chamber, while other portions of article 1350 remain exposed or outside of steaming chamber 1100. Thus, in some embodiments, steaming chamber 1100 can enclose or cover different portions of article 1350. In some embodiments, steaming chamber 1100 can enclose all or substantially all of article 1350. In other embodiments, there may be a portion of article 1350 that extends outward and upward and is exposed (i.e., is not enclosed within the various surfaces of steaming chamber 1100).

Generally, articles of footwear that can be utilized with steaming apparatus 1000 can be any type of footwear. For clarity, FIG. 13 depicts a type of sports shoe, but it should be noted that in other embodiments any other type of footwear could be used including, but not limited to, hiking boots, soccer shoes, football shoes, sneakers, rugby shoes, basketball shoes, baseball shoes, as well as other kinds of shoes. Articles of footwear may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. Additionally, while a single article of footwear is shown in FIG. 13, it should be understood that the same steaming apparatus could be utilized with a second, complementary article of footwear.

In different embodiments, in order to facilitate the use of steaming apparatus 1000 with a steam source, the materials comprising the various portions of steaming apparatus 1000 may vary. In some embodiments, one or more areas of steaming apparatus 1000, including the sheets, may include thermal or heat-insulating materials, such as plastics, fibrous insulations, glass, silica, rock wool, alumina silica, mineral wool, cellular insulations, elastomer, polyolefin, polyurethane, granular insulations, or other types of insulation material known in the art. Furthermore, other components of steaming apparatus 1000 may comprise other materials. Examples of different materials that could be used include, but are not limited to, metallic materials, polymer materials including plastics and/or rubbers, wooden materials, composite materials, steam-resistant materials, plastic, glass, PVC, polypropelyne as well as any other kinds of materials. Furthermore, portions of the steaming apparatus may be made of various generally flexible or inflexible materials. For example, steaming apparatus 1000 can comprise a silicone rubber insulation, natural rubber or other type of synthetic or plastic insulation coating. In some embodiments, materials comprising steaming apparatus 1000 may be substantially waterproof, water resistant, steam resistant, and/or substantially impermeable to steam and other gas or fluids.

Thus, steaming apparatus 1000 may include provisions for facilitating the customization of articles in different environments and locations. For example, in situations where frequent "breaking-in" of apparel is needed (e.g., sports players who may use over 7-12 pairs of articles of footwear each season) steaming apparatus 1000 may provide increased convenience, as well as great utility, by allowing players to have articles quickly steamed for customization soon before a match or sporting event. In another embodiment, some users may have injuries or conditions that require the use of specialized ankle or footwear support. Other users may appreciate the convenience of customization that can occur at their own homes, or in a location of their choosing. Furthermore, in some embodiments, the articles selected for customization may be purchased within the same shoebox as the steaming apparatus, providing consumers with a kit that is portable and efficient. The use of steaming apparatus 1000 can easily allow the user to steam his or her respective footwear and then insert his or her foot into steamed articles to help achieve an improved fit within a few minutes, and at a convenient location.

This description of features, systems, and components is not intended to be exhaustive and in other embodiments, steaming apparatus 1000 may include other features, systems, and/or components. Moreover, in other embodiments, some of these features, systems, and/or components could be optional. While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A method of manufacturing a steaming apparatus, the steaming apparatus comprising a first panel, a second panel, a third panel, and a fourth panel, the method comprising:

folding a first sheet to form a first folded sheet;

placing the first folded sheet between a second sheet and a third sheet to form a layered sheet set;

folding a fourth sheet along a longitudinal midline to form a second folded sheet, and placing the second folded sheet between the second sheet and the third sheet;

welding together a first portion of the layered sheet set to form a first weld portion in the layered sheet set, the first weld portion being directly adjacent to a first longitudinal edge of the layered sheet set and being elongated in a direction aligned with a longitudinal axis of the layered sheet set;

welding together a second weld portion of the layered sheet set adjacent to a second longitudinal edge of the layered sheet set, the second weld portion being elongated in the direction aligned with the longitudinal axis of the layered sheet set;

cutting through the layered sheet set to separate the first panel from the first sheet, the second panel from the second sheet, the third panel from the third sheet, and the fourth panel from the fourth sheet, thereby separating a layered panel set from the layered sheet set; and welding together a bottom portion of the second sheet directly to a bottom portion of the third sheet of the layered panel set to form a base portion in the steaming apparatus.

2. The method of claim 1, further comprising cutting through the layered sheet set to form a round hole in the second weld portion.

3. The method of claim 1, further comprising cutting through the layered sheet set to form a round hole in the first weld portion.

4. The method of claim 1, wherein the step of welding together the first weld portion of the layered sheet set further comprises welding around a channel portion that is configured to receive an elongated element.

5. The method of claim 1, wherein each sheet is formed of a lamination of polyester and polyurethane.

6. The method of claim 5, wherein the lamination includes a stiffener positioned between the polyester and the polyurethane.

7. The method of claim 1, further comprising:

drawing the second sheet from a second roll, the second sheet including a second edge;

drawing the third sheet from a third roll, the third sheet including a third edge;

positioning the third edge adjacent to, and parallel with, the second edge;

drawing the first sheet from a first roll; and arranging the layered sheet set such that the second edge abuts a first edge of the first sheet and the third edge abuts a fourth edge of the first sheet, and wherein each of the first sheet, the second sheet, and the third sheet is rectangular-shaped, folding the first sheet comprises folding the first sheet along a first longitudinal midline to form the first folded sheet such that the first edge of the first sheet adjoins the fourth edge of the first sheet, and the first weld portion includes a first elongated portion that is formed adjacent to both the second edge and the first edge.

8. The method of claim 7, wherein the first weld portion further includes a second elongated portion that is parallel to and spaced apart from the first elongated portion, forming a channel portion between the first elongated portion and the second elongated portion.

9. The method of claim 8, wherein the first weld portion further includes a first corner portion that is joined to the first elongated portion and the second elongated portion.

10. The method of claim 9 further comprising cutting the first corner portion to form a round hole through a thickness of the layered panel set.

11. The method of claim 8, further comprising inserting an elongated element into the channel portion.

12. The method of claim 1, further comprising:

positioning a second inner surface of the second sheet over a third inner surface of the third sheet such that the second inner surface and the third inner surface face toward each other, the second sheet being similar in width as the third sheet;

placing the first folded sheet between the second sheet and the third sheet such that a first fold line of the first folded sheet is parallel to a longitudinal axis of the second sheet;

placing a second folded sheet, formed from the fourth sheet, between the second sheet and the third sheet such that a second fold line of the second folded sheet is parallel to the longitudinal axis of the second sheet; and positioning the first folded sheet such that the second inner surface of the second sheet and a first folded outer surface of the first folded sheet contact each other, and the third inner surface of the third sheet and a second folded outer surface of the first folded sheet also contact each other, thereby forming the layered sheet set.

13. The method of claim 12, further comprising folding the fourth sheet to form the second folded sheet with a third folded outer surface and a fourth folded outer surface; and positioning the second folded sheet such that the second inner surface of the second sheet and the third folded outer surface of the second folded sheet contact each other, and the third inner surface of the third sheet and the fourth folded outer surface of the second folded sheet also contact each other.

14. The method of claim 12, further comprising removing a second layered panel set from the layered sheet set by cutting through the layered sheet set.

15. The method of claim 12, further comprising inserting an insulating material between a first fold portion and a second fold portion of the first folded sheet.

16. The method of claim 12, further comprising coating the second inner surface of the second sheet and the third inner surface of the third sheet with a heat weldable material.

17. The method of claim 16, further comprising coating the first folded outer surface of the first folded sheet and the second folded outer surface of the first folded sheet with the heat weldable material.

18. A method of manufacturing a steaming apparatus, the steaming apparatus comprising a first panel, a second panel, a third panel, and a fourth panel, the method comprising:

folding a first sheet to form a first folded sheet;

placing the first folded sheet between a second sheet and a third sheet to form a layered sheet set;

welding together a first portion of the layered sheet set to form a first weld portion in the layered sheet set, the first weld portion being directly adjacent to a first longitudinal edge of the layered sheet set and being elongated in a direction aligned with a longitudinal axis of the layered sheet set;

cutting through the layered sheet set to separate the first panel from the first sheet, the second panel from the second sheet, the third panel from the third sheet, and the fourth panel from a fourth sheet, thereby separating a layered panel set from the layered sheet set;

welding together a bottom portion of the layered panel set to form a base portion in the steaming apparatus;

further comprising:

drawing the second sheet from a second roll, the second sheet including a second edge;

drawing the third sheet from a third roll, the third sheet including a third edge;

positioning the third edge adjacent to, and parallel with, the second edge;

drawing the first sheet from a first roll; and arranging the layered sheet set such that the second edge abuts a first edge of the first sheet and the third edge abuts a fourth edge of the first sheet, and wherein each of the first sheet, the second sheet, and the third sheet is rectangular-shaped, folding the first sheet comprises folding the first sheet along a first longitudinal midline to form the first folded sheet such that the first edge of the first sheet adjoins the fourth edge of the first sheet, the first weld portion includes a first elongated portion that is formed adjacent to both the second edge and the first edge; and cutting and removing a triangular-shaped portion from the bottom portion to form an aperture in the base portion.

19. The method of claim 18, further comprising cutting and removing a first portion of the bottom portion and a second portion of the bottom portion to form a space between the base portion and a body portion of the steaming apparatus.

20. The method of claim 19, further comprising unfolding the base portion and placing one end of an article of footwear inside a steaming chamber formed in the steaming apparatus.

* * * * *